US011034507B2

(12) United States Patent
Spang, Jr. et al.

(10) Patent No.: US 11,034,507 B2
(45) Date of Patent: Jun. 15, 2021

(54) TRIGGER OVERCAP ASSEMBLY

(71) Applicant: S. C. Johnson & Son, Inc., Racine, WI (US)

(72) Inventors: Ronald H. Spang, Jr., Kenosha, WI (US); Richard M. Parysek, Westerville, OH (US); Imtiaz A. Musaliar, Evanston, IL (US); Steven A. Zach, Waterford, WI (US)

(73) Assignee: S. C. Johnson & Son, Inc., Racine, WI (US)

( * ) Notice: Subject to any disclaimer, the term of this patent is extended or adjusted under 35 U.S.C. 154(b) by 0 days.

(21) Appl. No.: 16/552,601

(22) Filed: Aug. 27, 2019

(65) Prior Publication Data

US 2020/0062489 A1 Feb. 27, 2020

Related U.S. Application Data

(60) Provisional application No. 62/723,304, filed on Aug. 27, 2018.

(51) Int. Cl.
*B65D 83/00* (2006.01)
*B65D 83/20* (2006.01)

(52) U.S. Cl.
CPC ..... *B65D 83/206* (2013.01)

(58) Field of Classification Search
CPC ... B65D 83/201; B65D 83/202; B65D 83/206
USPC ..... 222/402.13
See application file for complete search history.

(56) References Cited

U.S. PATENT DOCUMENTS

| | | | |
|---|---|---|---|
| D198,547 | S | 6/1964 | Vuillemenot |
| D200,609 | S | 3/1965 | Fahlstrom |
| D222,036 | S | 9/1971 | Carpenter |
| D229,825 | S | 1/1974 | Hayes |
| D232,499 | S | 8/1974 | Martinelli |
| D236,252 | S | 8/1975 | Sette |
| D238,934 | S | 2/1976 | Corba |
| 5,738,251 | A | 4/1998 | Schuckmann |
| 5,839,616 | A | 11/1998 | Irwin et al. |
| 6,095,377 | A | 8/2000 | Sweeton et al. |
| 6,116,472 | A | 9/2000 | Wanbaugh et al. |
| 6,286,728 | B1 | 9/2001 | Driskell et al. |

(Continued)

FOREIGN PATENT DOCUMENTS

| | | | |
|---|---|---|---|
| CA | 104739 | S | 1/2005 |
| CA | 124466 | S | 1/2009 |

(Continued)

OTHER PUBLICATIONS

International Search Report and Written Opinion issued in corresponding International Application No. PCT/US2019/048342, dated Nov. 15, 2019, 14 pages.

(Continued)

*Primary Examiner* — Paul R Durand
*Assistant Examiner* — Andrew P Bainbridge
(74) *Attorney, Agent, or Firm* — Quarles & Brady LLP

(57) ABSTRACT

A trigger overcap assembly includes a housing having a body, a cap secured to an upper end of the body, and a trigger at least partially disposed within the body. The trigger includes a manifold having a fluid passageway, and a pivot rod of the trigger is pivotally coupled with a pivot notch of the cap.

22 Claims, 16 Drawing Sheets

(56) References Cited

U.S. PATENT DOCUMENTS 6,332,562 B1 12/2001 Sweeton
6,378,786 B1 4/2002 Beeston et al.
RE38,022 E 3/2003 De Laforcade
D476,558 S 7/2003 Cho et al.
D488,535 S 4/2004 Foster et al.
6,722,532 B2 4/2004 Lasserre et al.
D489,970 S 5/2004 Nelson et al.
6,758,373 B2 7/2004 Jackson et al.
6,834,778 B2 12/2004 Jinbo et al.
6,860,411 B2 3/2005 Stradella
D507,493 S 7/2005 Nelson et al.
D510,408 S 10/2005 Bitowft et al.
6,978,946 B2 12/2005 Sweeton
D514,933 S 2/2006 Bitowft et al.
7,028,866 B2 * 4/2006 Kunesh ..... B65D 83/38 215/382
D525,123 S 7/2006 Walters et al.
D528,418 S 9/2006 Kuo
7,108,159 B2 9/2006 Stradella
D531,500 S 11/2006 Perry et al.
7,137,536 B2 11/2006 Walters et al.
7,137,537 B2 11/2006 Rueschhoff et al.
7,140,515 B2 11/2006 Cardwell, III et al.
D534,077 S 12/2006 Paas et al.
D535,188 S 1/2007 Lee
D537,359 S 2/2007 Butler et al.
D538,650 S 3/2007 Paas et al.
D539,142 S 3/2007 Butler et al.
7,204,393 B2 4/2007 Strand
D545,190 S 6/2007 Wu
D548,078 S 8/2007 Foster
D552,991 S 10/2007 Lai
7,296,712 B2 11/2007 Stradella
D559,682 S 1/2008 Meeker et al.
7,325,705 B2 2/2008 Sweeton
7,344,053 B2 3/2008 Sweeton
7,350,675 B2 4/2008 Sweeton
7,360,672 B2 4/2008 Sweeton
D569,723 S 5/2008 Sellick
D570,214 S 6/2008 Foster et al.
D571,206 S 6/2008 Sweeton et al.
D577,587 S 9/2008 Witte
D580,273 S 11/2008 Stinesen et al.
D580,761 S 11/2008 Sweeton
7,455,198 B2 11/2008 Foster et al.
D581,789 S 12/2008 Ames et al.
D582,272 S 12/2008 Cichy
D583,668 S 12/2008 Sweeton
D588,456 S 3/2009 Dejong et al.
7,497,358 B2 3/2009 Clynes et al.
D590,712 S 4/2009 Sweeton
D591,612 S 5/2009 Ames et al.
D595,575 S 7/2009 Cichy
D598,283 S 8/2009 Ames et al.
7,571,836 B2 8/2009 Foster et al.
D600,119 S 9/2009 Sweeton
D604,610 S 11/2009 Ames et al.
7,621,468 B2 11/2009 Smith et al.
D605,953 S 12/2009 Wang Treadway et al.
7,637,396 B2 12/2009 Foster et al.
7,641,079 B2 * 1/2010 Lott ..... B65D 83/201 222/153.07
7,677,416 B2 3/2010 Foster et al.
7,721,920 B2 5/2010 Ruiz De Gopegui et al.
7,757,567 B2 7/2010 Joyce et al.
7,784,650 B2 8/2010 Bates et al.
D623,071 S 9/2010 Driskell et al.
D627,224 S 11/2010 Bass et al.
D634,194 S 3/2011 Driskell et al.
D639,160 S 6/2011 Jug et al.
D645,745 S 9/2011 Driskell et al.
8,016,167 B2 9/2011 Tomkins et al.
D647,805 S 11/2011 Broen et al.
D649,048 S 11/2011 Baker et al.
D649,456 S 11/2011 Baker et al.
8,066,155 B2 11/2011 Tada
8,123,082 B2 2/2012 Hayton et al.
D660,150 S 5/2012 Fournet
8,167,176 B2 5/2012 Stradella
D661,987 S 6/2012 Broen et al.
8,196,784 B2 6/2012 Tomkins et al.
8,201,714 B2 6/2012 Tomkins et al.
D665,260 S 8/2012 Driskell et al.
D673,448 S 1/2013 Cohen et al.
D674,469 S 1/2013 Boyer
D674,695 S 1/2013 Thurin et al.
D675,103 S 1/2013 Broen et al.
8,444,026 B2 5/2013 Adams et al.
8,499,984 B2 * 8/2013 Strand ..... B05B 11/3057 222/402.13
D697,815 S 1/2014 Broen et al.
D705,651 S 5/2014 Neumann et al.
D708,061 S 7/2014 Orasche
D710,200 S 8/2014 Takizawa et al.
D710,697 S 8/2014 Lind
D713,251 S 9/2014 Driskell et al.
8,840,045 B2 9/2014 Thurin et al.
8,863,995 B2 10/2014 Stegeman
D718,130 S 11/2014 Wilcox et al.
8,881,944 B2 11/2014 Paas et al.
D718,624 S 12/2014 Hanson
8,936,180 B2 1/2015 Sell
D721,961 S 2/2015 Takizawa et al.
D723,368 S 3/2015 Checklin et al.
8,998,041 B2 * 4/2015 Strand ..... B05B 11/3057 222/402.15
9,004,324 B2 4/2015 Adams et al.
D731,321 S 6/2015 Farrell et al.
9,061,816 B2 * 6/2015 Best ..... B65D 83/206
9,061,817 B2 6/2015 Lind et al.
D735,036 S 7/2015 Broen et al.
D746,135 S 12/2015 Lind
D752,977 S 4/2016 Herbst et al.
D758,878 S 6/2016 Hoeke et al.
9,375,593 B2 6/2016 Fishman et al.
D761,650 S 7/2016 Hoeke et al.
9,435,120 B2 9/2016 Hanson et al.
9,475,635 B2 10/2016 Driskell et al.
D773,929 S 12/2016 Richard et al.
D777,033 S 1/2017 Takizawa et al.
D787,326 S 5/2017 Hanson et al.
D790,342 S 6/2017 Farrell et al.
9,738,436 B2 8/2017 Sell
D796,322 S 9/2017 Hanson
9,758,294 B2 9/2017 McDaniel et al.
9,955,765 B2 5/2018 Schmitz et al.
10,322,428 B2 6/2019 Van Houten et al.
D866,325 S 11/2019 Tu
D873,137 S 1/2020 Takizawa et al.
D873,149 S 1/2020 Gooden
10,647,501 B2 * 5/2020 Richard ..... B65D 83/206
2004/0140328 A1 7/2004 Pericard et al.
2004/0188473 A1 9/2004 Groh et al.
2004/0222246 A1 11/2004 Bates et al.
2006/0180612 A1 8/2006 Paas et al.
2008/0290113 A1 * 11/2008 Helf ..... B65D 83/24 222/52
2008/0290120 A1 11/2008 Helf et al.
2009/0114215 A1 5/2009 Boeck et al.
2010/0059551 A1 * 3/2010 Tomkins ..... B65D 83/206 222/402.13
2010/0108857 A1 5/2010 Andrae
2011/0108583 A1 5/2011 Sell et al.
2013/0146611 A1 6/2013 Sell
2013/0153607 A1 6/2013 Sell
2013/0277397 A1 10/2013 Erickson et al.
2014/0084026 A1 3/2014 Gillespie et al.
2014/0110440 A1 * 4/2014 Good ..... B65D 83/206 222/402.13
2014/0209633 A1 7/2014 McDaniel et al.
2014/0346193 A1 11/2014 Conway et al.
2017/0305645 A1 10/2017 Sell

(56) References Cited

U.S. PATENT DOCUMENTS

| | | | | |
|---|---|---|---|---|
| 2018/0099808 | A1* | 4/2018 | Richard | B65D 83/202 |
| 2020/0062489 | A1* | 2/2020 | Spang, Jr. | B65D 83/206 |

FOREIGN PATENT DOCUMENTS

| | | | |
|---|---|---|---|
| CA | 129347 | S | 1/2009 |
| CA | 129348 | S | 1/2009 |
| CA | 129349 | S | 1/2009 |
| CA | 2656031 | C | 10/2013 |
| CA | 2618034 | C | 3/2014 |
| CN | 1257017 | C | 5/2006 |
| CN | 100534631 | C | 9/2009 |
| CN | 103619728 | B | 3/2016 |
| EM | 000097969-0001 | | 11/2003 |
| EM | 000385471-0001 | | 8/2005 |
| EM | 000385471-0002 | | 8/2005 |
| EM | 000385471-0003 | | 8/2005 |
| EM | 000385471-0004 | | 8/2005 |
| EM | 000385489-0001 | | 8/2005 |
| EM | 000385489-0002 | | 8/2005 |
| EM | 000385489-0003 | | 8/2005 |
| EM | 000385489-0004 | | 8/2005 |
| EM | 000405980-0001 | | 9/2005 |
| EM | 000405980-0002 | | 9/2005 |
| EM | 000452354-0001 | | 12/2005 |
| EM | 000452354-0002 | | 12/2005 |
| EM | 000452354-0003 | | 12/2005 |
| EM | 000452354-0004 | | 12/2005 |
| EM | 000647839-0001 | | 1/2007 |
| EM | 000860259-0001 | | 1/2008 |
| EM | 000860259-0002 | | 1/2008 |
| EM | 000860259-0003 | | 1/2008 |
| EM | 000860259-0004 | | 1/2008 |
| EM | 000860259-0005 | | 1/2008 |
| EM | 000860259-0006 | | 1/2008 |
| EM | 000971221-0001 | | 7/2008 |
| EM | 001009054-0001 | | 9/2008 |
| EM | 001009054-0002 | | 9/2008 |
| EM | 001009054-0003 | | 9/2008 |
| EM | 001009054-0004 | | 9/2008 |
| EM | 001009054-0005 | | 9/2008 |
| EM | 001009054-0006 | | 9/2008 |
| EM | 002070086-0001 | | 7/2012 |
| EM | 002070086-0002 | | 7/2012 |
| EM | 002182121-0001 | | 2/2013 |
| EM | 002182121-0002 | | 2/2013 |
| EM | 002182121-0003 | | 2/2013 |
| EM | 002511758-0004 | | 7/2014 |
| EM | 002511758-0005 | | 7/2014 |
| EM | 003534486-0001 | | 12/2016 |
| EM | 003534486-0002 | | 12/2016 |
| EP | 2297003 | A2 | 3/2011 |
| EP | 2346748 | A1 | 7/2011 |
| JP | 1336737 | S | 6/2008 |
| JP | 1336738 | S | 6/2008 |
| JP | 2015030460 | A | 2/2015 |
| MX | 247079 | B | 7/2007 |
| MX | 283783 | B | 2/2011 |
| MX | 2010013544 | A | 2/2011 |
| MX | 2013002100 | A | 5/2013 |
| MX | 354198 | B | 2/2018 |
| WO | 2009152112 | A1 | 12/2009 |
| WO | 2010008462 | A2 | 1/2010 |
| WO | 2010056724 | A1 | 5/2010 |
| WO | DM076856 | | 5/2011 |
| WO | 2012166793 | A1 | 12/2012 |
| WO | DM081741 | | 9/2013 |
| WO | DM082807 | | 11/2013 |
| WO | DM082809 | | 11/2013 |
| WO | 2016163987 | A1 | 10/2016 |

OTHER PUBLICATIONS

"Pink Fine Mist Sprayer & Dip Tube for 5 oz. Bottle | U.S. Plastic Corp," United States Plastic Corp., 2 pages. Retrieved from Internet on Dec. 5, 2017, URL: https://www.usplastic.com/catalog/item.aspx? itemid=126360&catid=470.

"Plastic Continuous Fine Mist Spray Bottle Finger Sprayer Bottle Rd-107x," Alibaba.com, 13 pages. Retrieved from Internet on Dec. 5, 2017, URL: https://www.alibaba.com/product-detail/300ML-Plastic-Continuous-Fine-Mist-Spray_60641511667.html?spm=a2700.7724857.main07.21.66de1d87Dy.

"Salon Water spray bottle automatic high pressurized Mist spray Water bottle," eBay, Sep. 18, 2017, 8 pages. Retrieved from Internet on Dec. 5, 2017, URL: https://www.ebay.in/itm/Salon-Water-spray-bottle-automatic-high-pressurized-Mist-spray-Water-bottle-/282550002825?hash=item41c94ae489.

* cited by examiner

TRIGGER OVERCAP ASSEMBLY

CROSS REFERENCE TO RELATED APPLICATIONS

This application claims the benefit of U.S. Provisional Application No. 62/723,304, filed on Aug. 27, 2018, which is incorporated herein by reference in its entirety.

REFERENCE REGARDING FEDERALLY SPONSORED RESEARCH OR DEVELOPMENT

Not applicable

SEQUENCE LISTING

Not applicable

BACKGROUND OF THE INVENTION

1. Field of the Invention

The present invention relates generally to a trigger overcap assembly including a housing and cover, and more particularly, to a trigger that is pivotally coupled with the cover.

2. Description of the Background of the Invention

Pressurized containers are commonly used to store and dispense volatile materials, such as air fresheners, deodorants, insecticides, germicides, decongestants, perfumes, and the like. The volatile materials are typically stored in a pressurized and liquefied state within the container. The product is forced from the container through an aerosol valve by a hydrocarbon or non-hydrocarbon propellant. A release valve with an outwardly extending valve stem may be provided to facilitate the release of the volatile material at a top portion of the container, whereby activation of the valve via the valve stem causes volatile material to flow from the container through the valve stem and into the outside atmosphere. The release valve may typically be activated by tilting, depressing, or otherwise displacing the valve stem. A typical valve assembly includes a valve stem, a valve body, and a valve spring. The valve stem extends through a pedestal, wherein a distal end extends upwardly away from the pedestal and a proximal end is disposed within the valve body.

Pressurized containers frequently include an overcap assembly that covers a top end of the container. Typical overcap assemblies are releasably attached to the container by way of an outwardly protruding ridge, which circumscribes the interior lower edge of the trigger overcap assembly and interacts with a bead or seam that circumscribes a top portion of the container. When the trigger overcap assembly is placed onto the top portion of the container, downward pressure is applied to the trigger overcap assembly, which causes the ridge to ride over an outer edge of the seam and lock under a ledge defined by a lower surface of the seam.

Typical overcap assemblies include a mechanism for engaging the valve stem of the container. Some actuator mechanisms may include linkages that apply downward pressure to depress the valve stem and open the valve within the container. Other actuating mechanisms may instead apply radial pressure where the container has a tilt-activated valve stem. In any case, these actuating mechanisms provide a relatively convenient and easy to use interface for end users.

Conventional actuating mechanisms include either an actuating button or an actuating trigger. Traditional actuating triggers may include a discharge orifice along a portion of the trigger, or at a separate location along a housing of the trigger overcap assembly. Regardless of the positioning of the discharge orifice, after actuation by a user, the volatile material typically travels through a fluid passageway. Portions defining the passageway typically engage the valve stem of an associated container. Thus, when dispensement is desired, a user may actuate the trigger, which in turn depresses the valve stem and opens the valve within the associated container, thereby releasing the contents of the container through the fluid passageway and out of the discharge orifice.

In other containers, the valve stem is tilted or displaced in a direction transverse to the longitudinal axis to radially actuate the valve stem. When the valve assembly is opened, a pressure differential between the container interior and the atmosphere forces the contents of the container out through an orifice of the valve stem.

Numerous problems arise with prior art trigger actuation systems utilized in combination with containers. In particular, many prior art trigger actuation systems require complex manufacturing processes requiring overly burdensome alignment and engagement steps. Further, prior art trigger actuation systems have historically required a number of moving parts or linkages to actuate the valve stem after actuation by a user. These and other disadvantage of the prior art are overcome by the trigger assembly described hereinafter.

SUMMARY OF THE INVENTION

According to one aspect, a trigger overcap assembly includes a housing having a body, a cap secured to an upper end of the housing, and a trigger at least partially disposed within the body. The trigger defines a manifold comprising a fluid passageway, and a pivot rod of the trigger is pivotally coupled with a pivot notch of the cap.

According to a different aspect, a four piece trigger overcap assembly consists of a housing, a cap secured to an upper end of the housing, a trigger at least partially disposed within the housing, and a nozzle insert disposed within a nozzle chamber of the trigger actuator. The trigger defines a fluid passageway, and a pivot rod of the trigger actuator is pivotally coupled with the cap.

According to another aspect, a trigger overcap assembly includes a housing defined by a waisted body from which extends a lower sidewall, a cap secured to an upper end of the body, and a trigger at least partially disposed within the body. The trigger includes a trigger pad from which a first arm and a second arm extend into the housing. The trigger defines a manifold comprising a fluid passageway, and a pivot rod connecting the first and second arms of the trigger is pivotally coupled with a pivot notch within a leg depending from the cap.

DETAILED DESCRIPTION OF THE DRAWINGS

Figure 1:
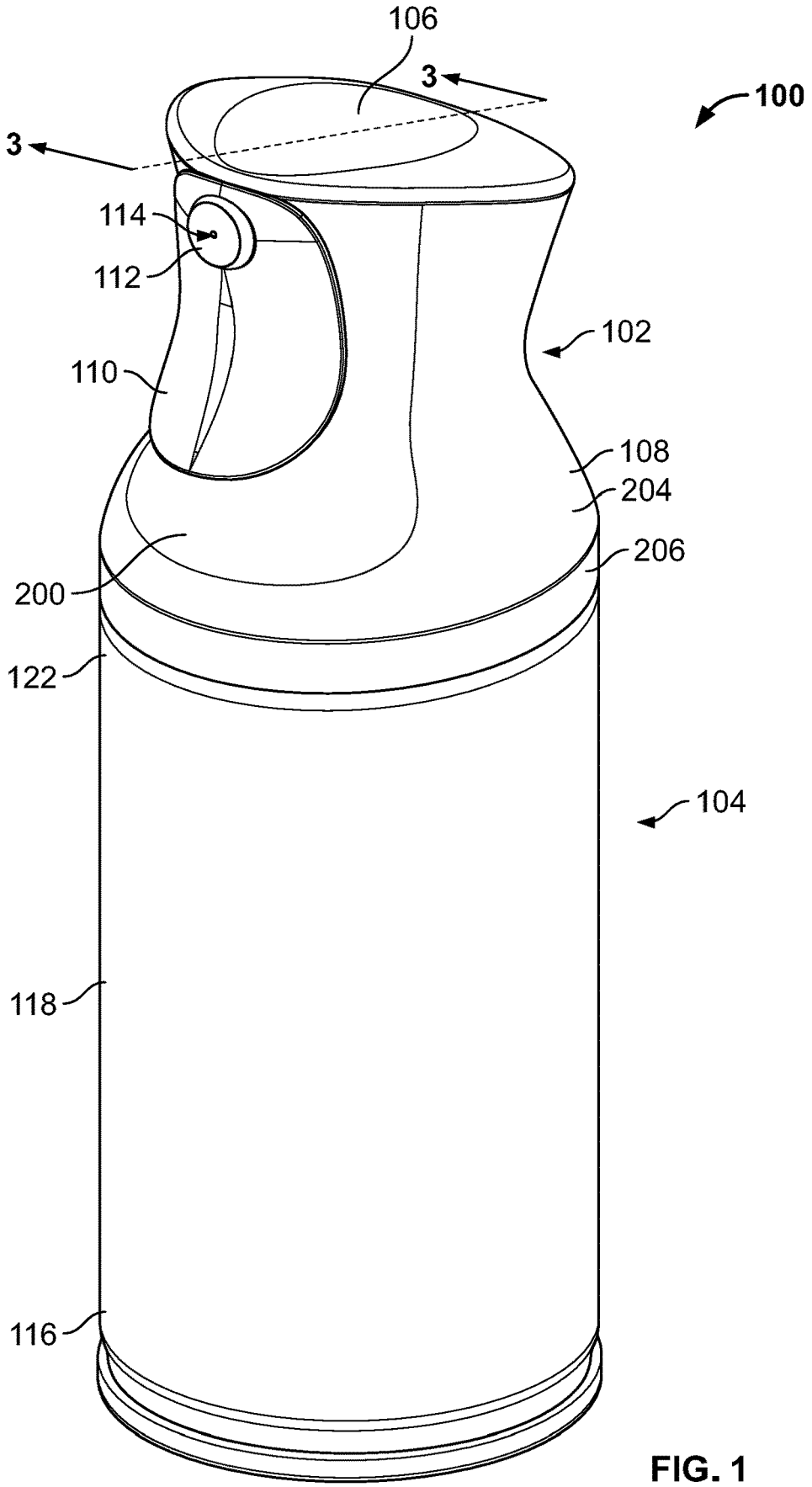
FIG. 1 is a top, front isometric view of a dispensing system including a trigger overcap assembly attached to an aerosol container.

FIG. 1 depicts a product dispensing system 100 including a trigger overcap assembly 102 and a container 104. The trigger overcap assembly 102 includes a cap 106, a housing 108, a trigger 110, and a nozzle insert 112. The trigger 110 is at least partially disposed within the housing 108 and facilitates the product being dispensed from the dispensing system 100. In use, the trigger overcap assembly 102 is adapted to release a product from the container 104 upon the occurrence of a particular condition, such as the manual activation of the trigger 110 by a user of the dispensing system 100. The product discharged may be a formulation, carrier, or substance for use in the cleaning of surfaces or objects in a household, commercial, or industrial environment. The product is discharged through an outlet orifice 114 of the nozzle insert 112.

In other embodiments, the product comprises a fragrance or insecticide disposed within a carrier liquid, a deodorizing liquid, or the like. The product may also comprise other actives, such as sanitizers, air fresheners, cleaners, odor eliminators, mold or mildew inhibitors, insect repellents, and/or the like, and/or that have aromatherapeutic properties. The product alternatively comprises any solid, liquid, or gas known to those skilled in the art that may be dispensed from a container. It is contemplated that the container 104 may contain any type of pressurized or non-pressurized product, such as compressed gas that may be liquefied, non-liquefied, or dissolved, including carbon dioxide, helium, hydrogen, neon, oxygen, xenon, nitrous oxide, or nitrogen. The container 104 may alternatively contain any type of hydrocarbon gas, including acetylene, methane, propane, butane, isobutene, halogenated hydrocarbons, ethers, mixtures of butane and propane, otherwise known as liquid petroleum gas or LPG, and/or mixtures thereof. The product dispensing system 100 is therefore adapted to dispense any number of different products.

The container 104 and/or trigger overcap assembly 102 may each be independently made of any appropriate material, including multiple layers of the same or different material, such as a polymer, a plastic, metal such as aluminum, an aluminum alloy, or tin plated steel, glass, a cellulosic material, a laminated material, a recycled material, and/or combinations thereof. The trigger overcap assembly 102 may be formed from a wide variety of well-known polymeric materials, including, for example, polyethylene (PE), low density polyethylene (LDPE), high density polyethylene (HDPE), polyethylene terephthalate (PET), crystalline PET, amorphous PET, polyethylene glycol terephthalate, polystyrene (PS), polyamide (PA), polyvinyl chloride (PVC), polycarbonate (PC), poly(styrene:acrylonitrile) (SAN), polymethylmethacrylate (PMMA), polypropylene (PP), polyethylene naphthalene (PEN), polyethylene furanoate (PEF), PET homopolymers, PEN copolymers, PET/PEN resin blends, PEN homopolymers, overmolded thermoplastic elastomers (TPE), fluropolymers, polysulphones, polyimides, cellulose acetate, and/or combinations thereof. It is further envisioned that the container 104 may include an interior and/or exterior lining or coating to further strengthen the container 104 structurally, as well as make the container 104 resilient to harsh chemicals. The lining(s) and/or coating(s) may be made of any one of the preceding polymeric materials or may further be made of ethylenevinyl alcohol (EVOH). The container 104 may be opaque, translucent, or transparent.

Figure 2:
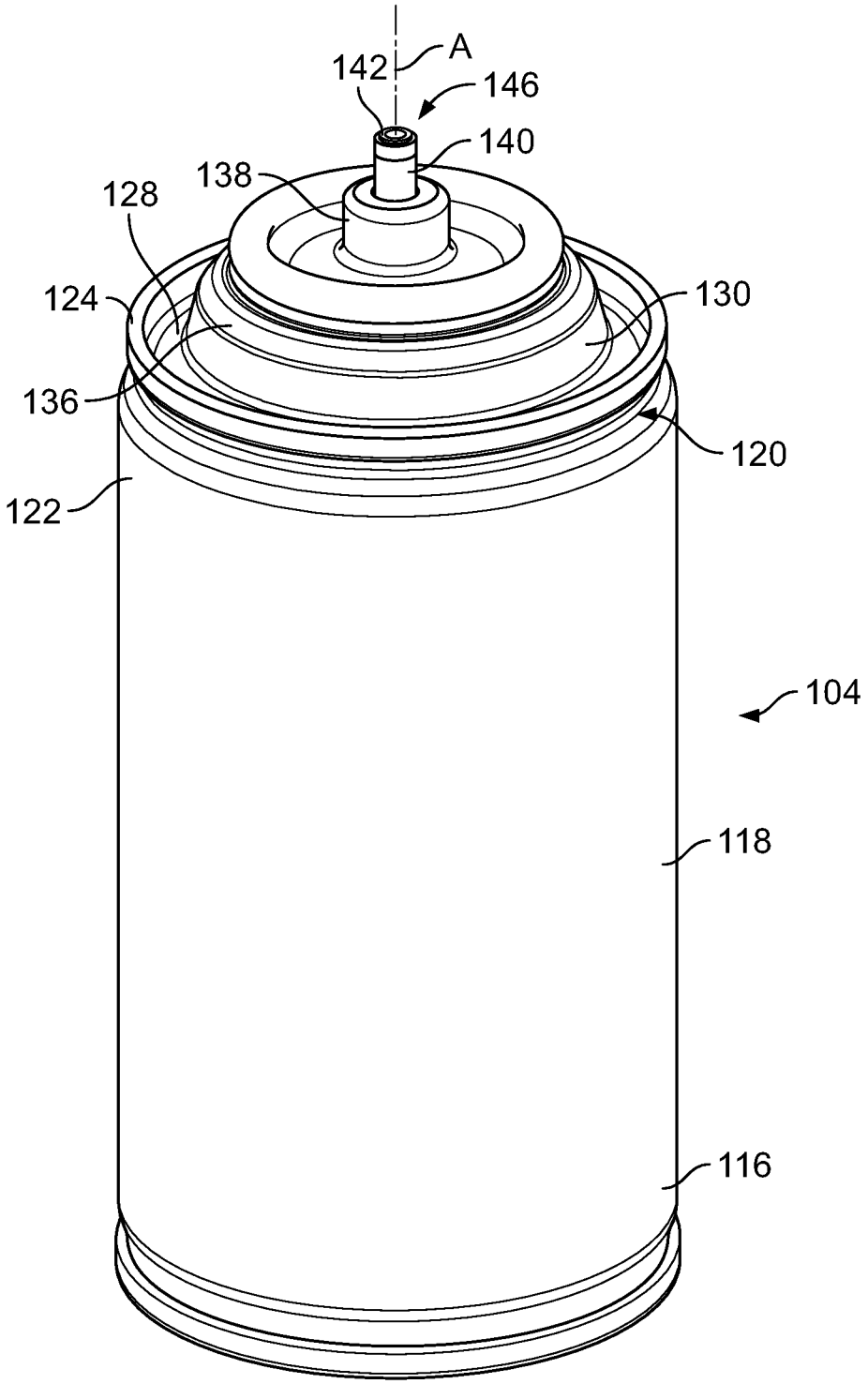
FIG. 2 is an isometric view of the aerosol container of FIG. 1 without the trigger overcap assembly coupled thereto.

As best illustrated in FIG. 2, the container 104 includes a lower end 116 and a substantially cylindrical body 118, which terminates at a groove 120 disposed at an upper end 122 of the container 104. The overcap assembly 102 may be attached to the container 104 via the groove 120, as discussed below. A rim 124 is disposed adjacent and above the groove 120, and joins a platform 128 that partially defines the upper end 122 of the container 104. The platform 128 is generally annular. It is contemplated that the container 104 of the present disclosure may be a conventional aerosol container, which includes features that are externally or internally crimped to portions of the body 118 and/or the rim 124. For example, as illustrated in FIG. 2, a mounting cup or crown 130 may be externally crimped to the container 104 at the rim 124.

Still referring to FIG. 2, the crown 130 of the container 104 is centrally interrupted by a pedestal 136. The pedestal 136 extends upwardly from the platform 128 of the crown 130. A valve pedestal 138 extends from a central portion of the pedestal 136, and includes a conventional valve assembly (not shown in detail) having a valve stem 140, which is connected to a valve body (not shown) and a valve spring (not shown) disposed within the container 104. The valve stem 140 extends upwardly through the valve pedestal 138, wherein a distal end 142 of the valve stem 140 extends upwardly away from the valve pedestal 138 and is adapted to interact with a fluid inlet of the trigger 110 of the trigger overcap assembly 102. A longitudinal axis A extends through the valve stem 140. It is also contemplated that other types of containers 104 or bottles may be used with the trigger overcap assembly 102 disclosed herein.

Figure 3:
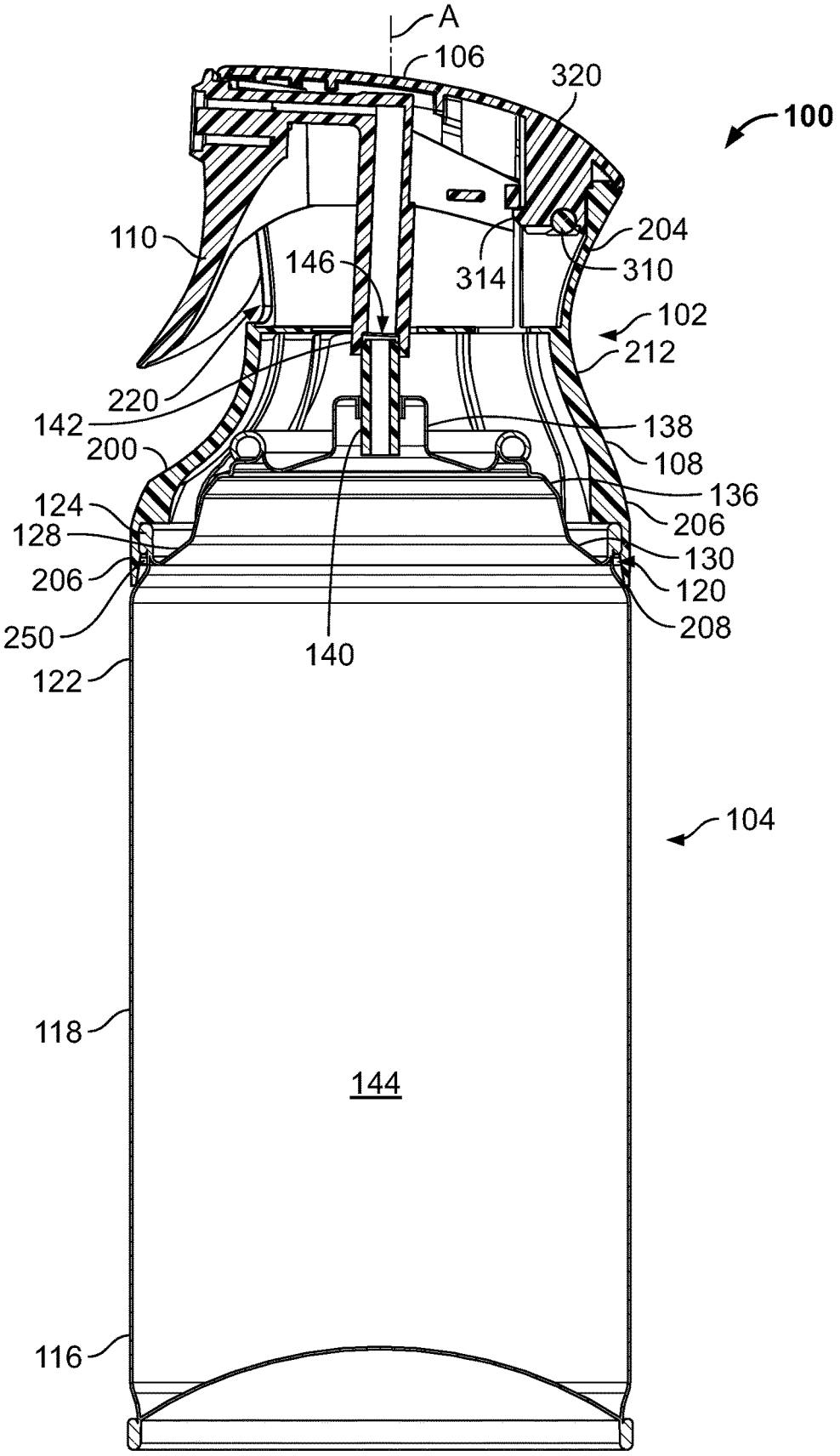
FIG. 3 is a partial cross-sectional side view of the dispensing system of FIG. 1 taken along the line 3-3 of FIG. 1.
Figure 4:
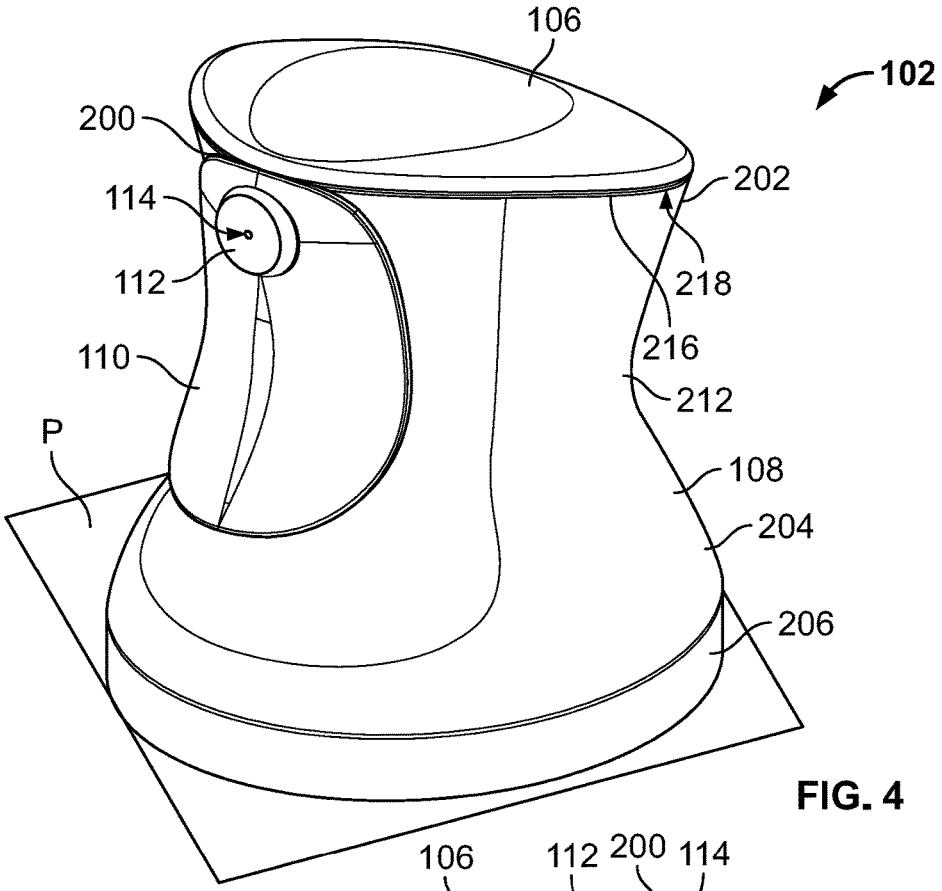
FIG. 4 is a top, front isometric view of the trigger overcap assembly of FIG. 1.
Figure 5:
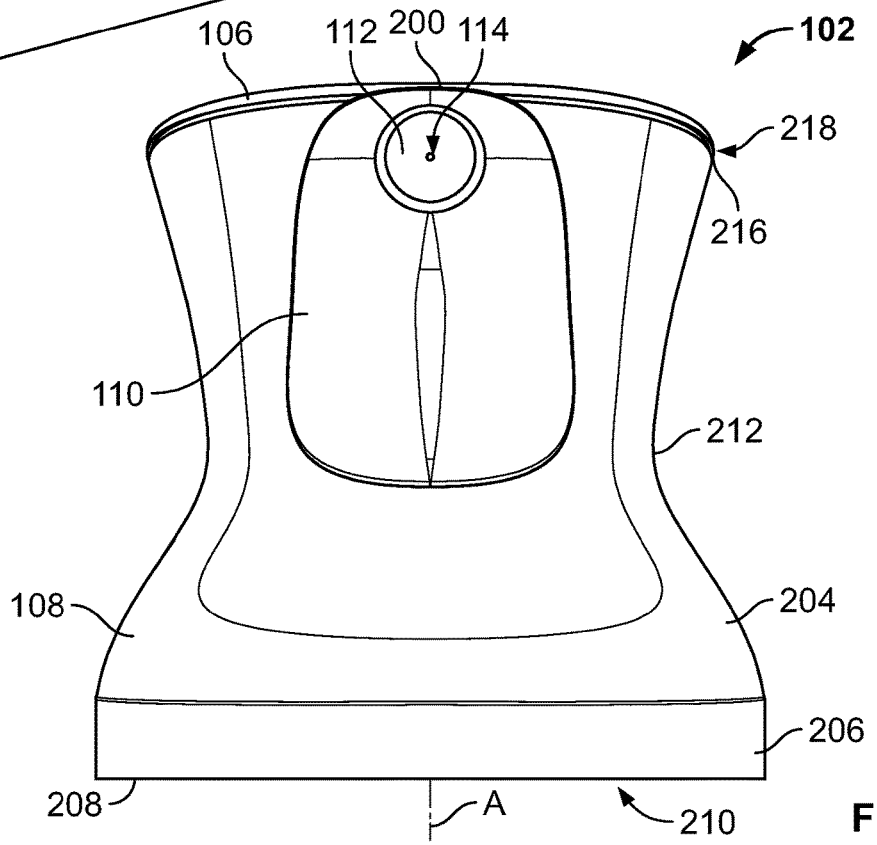
FIG. 5 is a front elevational view of the trigger overcap assembly of FIG. 4.
Figure 6:
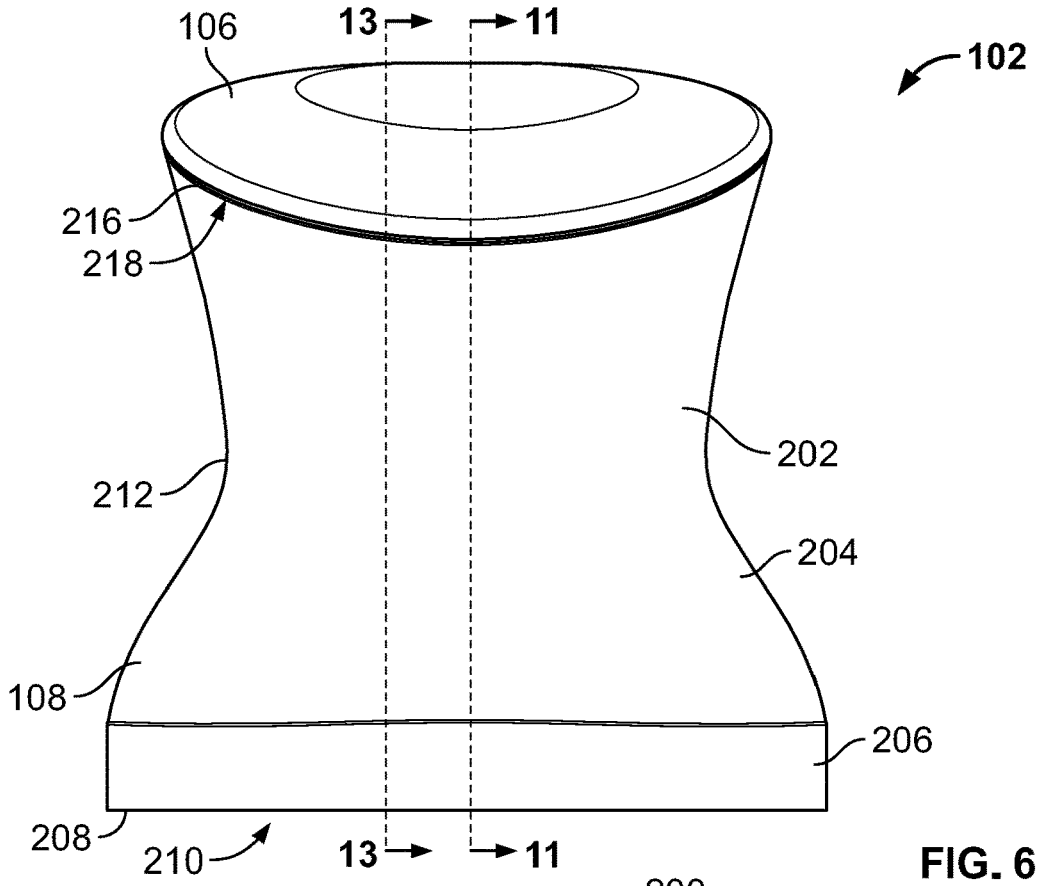
FIG. 6 is rear elevational view of the trigger overcap assembly of FIG. 4.

As best shown in FIG. 3, prior to use, the trigger 110 is placed in fluid communication with the distal end 142 of the valve stem 140. A user may manually or automatically actuate the trigger 110 to open the valve assembly, which causes a pressure differential between an interior 144 of the container 104 and the atmosphere to force the contents of the container 104 out through an orifice 146 of the valve stem 140, through the trigger overcap assembly 102, and into the atmosphere. The nozzle insert 112 is shown removed from the cross-sectional views included herein for purposes of clarity.

Figure 9:
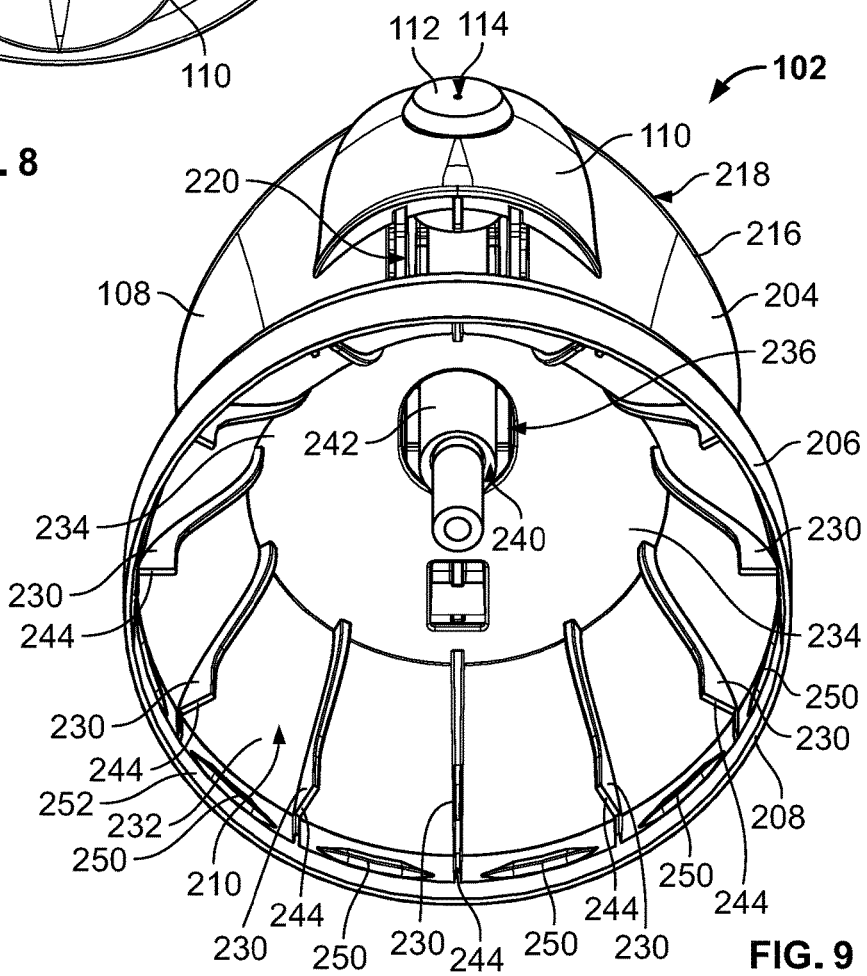
FIG. 9 is a bottom front isometric view of the trigger overcap assembly of FIG. 4.
Figure 10:
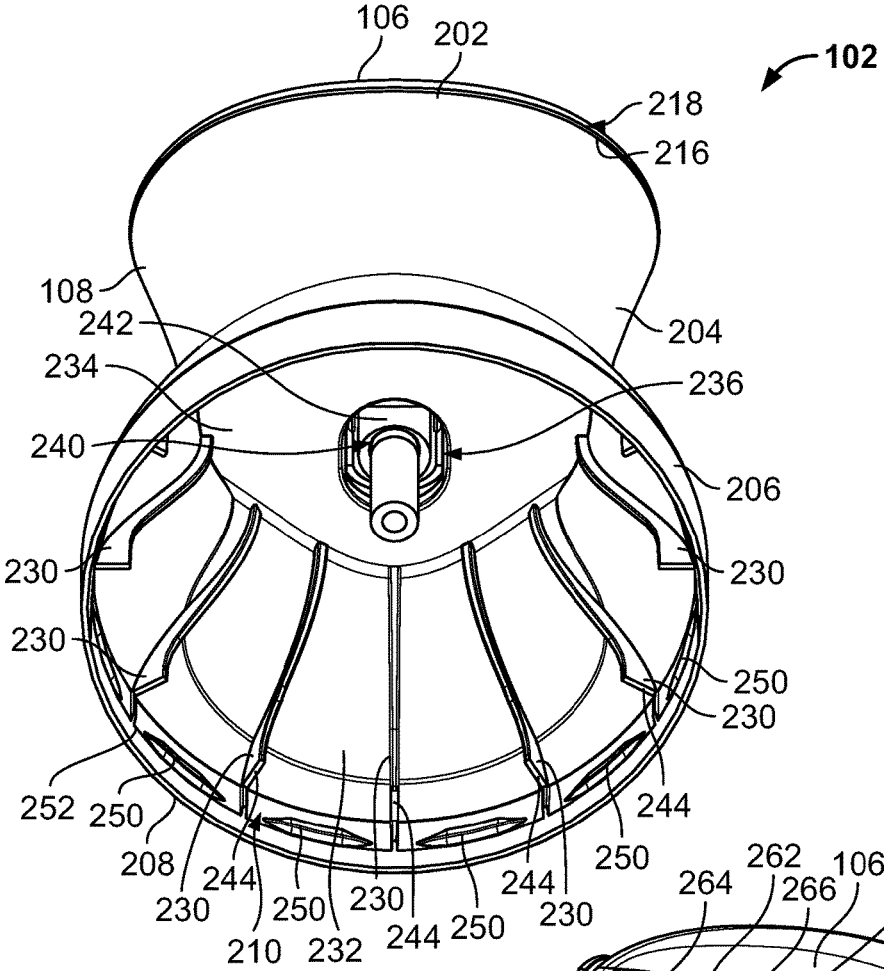
FIG. 10 is a bottom rear isometric view of the trigger overcap assembly of FIG. 4.

Now turning to FIGS. 4-8, the trigger overcap assembly 102 is described with greater particularity. The housing 108 of the trigger overcap assembly 102 is defined as having a front portion 200 and a rear portion 202. The housing 108 includes a waisted body 204 that extends upward and inward toward the longitudinal axis A from a lower sidewall 206. As previously noted, the longitudinal axis A is defined through the valve stem 140 of the container 104. The lower sidewall 206 is generally cylindrical in the present embodiment; however, the lower sidewall 206 may also be tapered. The lower sidewall 206 also defines a lower edge 208 of the housing 108. A plane P is defined by the lower edge 208 of the housing 108. As illustrated in FIGS. 9 and 10, the lower edge 208 of the lower sidewall 206 is generally circular and defines a lower opening 210 of the housing 108. The lower sidewall 206 may optionally include a lip.

Figure 7:
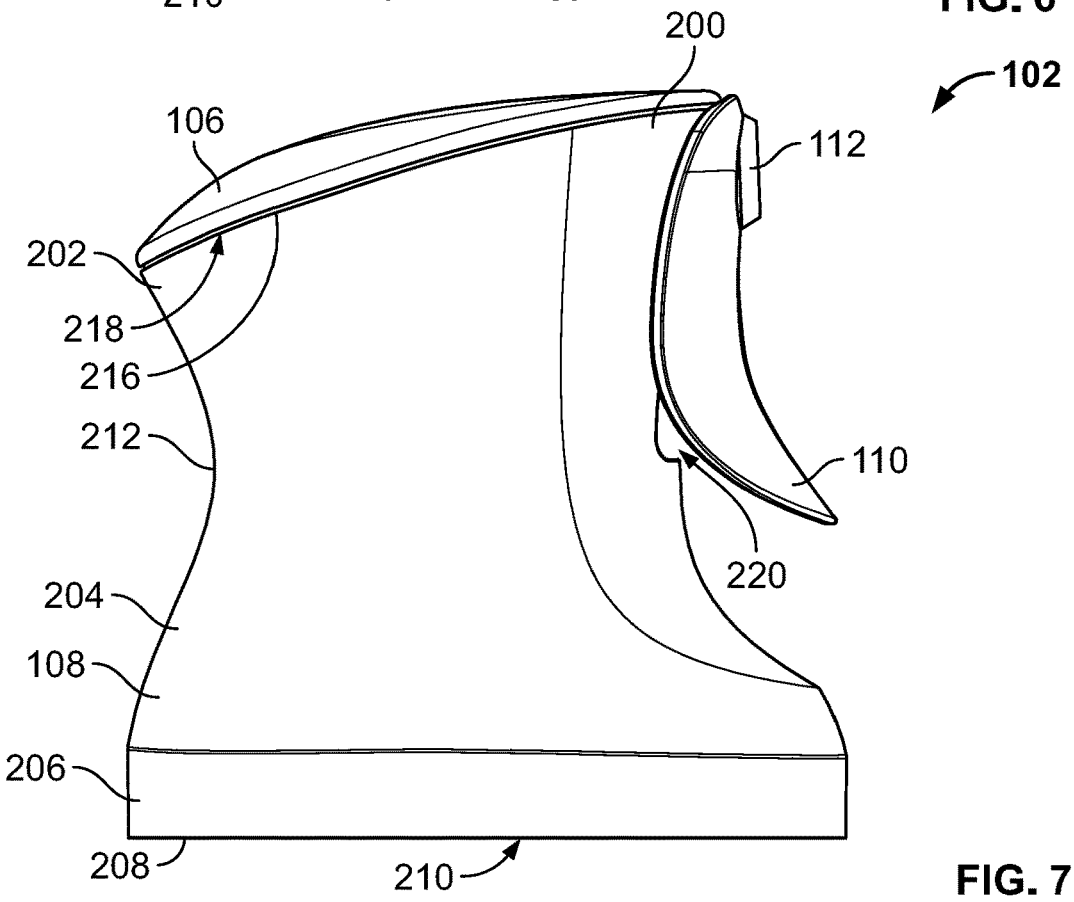
FIG. 7 is a left side elevational view of the trigger overcap assembly of FIG. 4, the right side view being a mirror image thereof.
Figure 8:
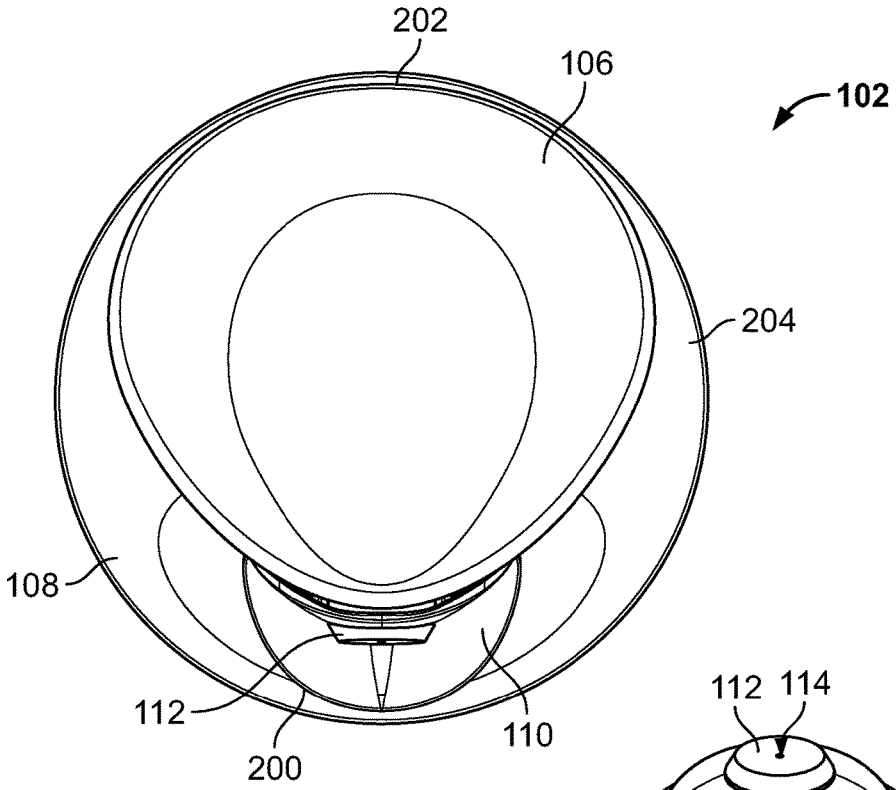
FIG. 8 is a top plan view of the trigger overcap assembly of FIG. 4.

Referring again to FIGS. 4-8, the body 204 tapers or bows inwardly, toward the axis A from the lower sidewall 206 toward a waist 212. From the waist 212, the body 204 extends upward, away from plane P, and outward, away from axis A, toward an upper opening 214 (see FIGS. 12 and 13) defined by an upper edge 216 of the body 204. The upper opening 214 is covered by the cap 106 when the cap 106 is affixed to the body 204. Referring specifically to FIG. 7, the upper edge 216 slopes downward, toward plane P, moving from the front portion 200 of the housing 108 toward the rear portion 202 thereof. The upper edge 216 is slightly curved, and the cap 106 follows the curvature thereof such that a seam 218 circumscribes the intersection between the cap 106 and the upper edge 216 of the housing 108. The upper opening 214 is adapted to receive the cap 106, as will be described in more detail hereinafter below. The housing 108 further includes a trigger opening 220 disposed at least partially above the waist 212 along the front portion 200 of the housing 108, which allows for the placement of the trigger 110 therethrough.

Figure 11:
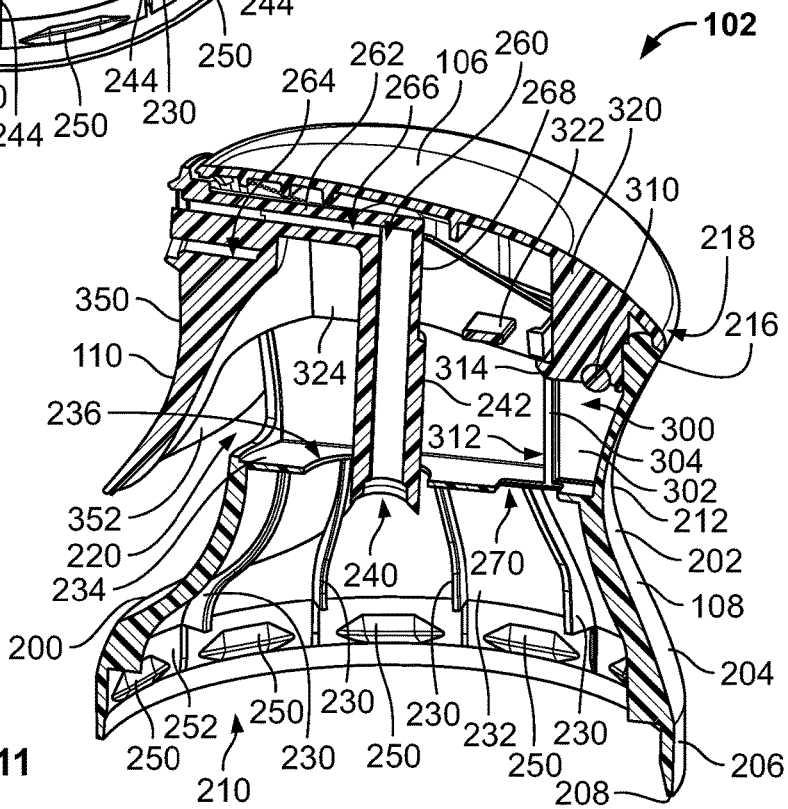
FIG. 11 is a top, rear isometric cross-sectional view of the trigger overcap assembly of FIG. 4 taken along line 11-11 of FIG. 6.
Figure 12:
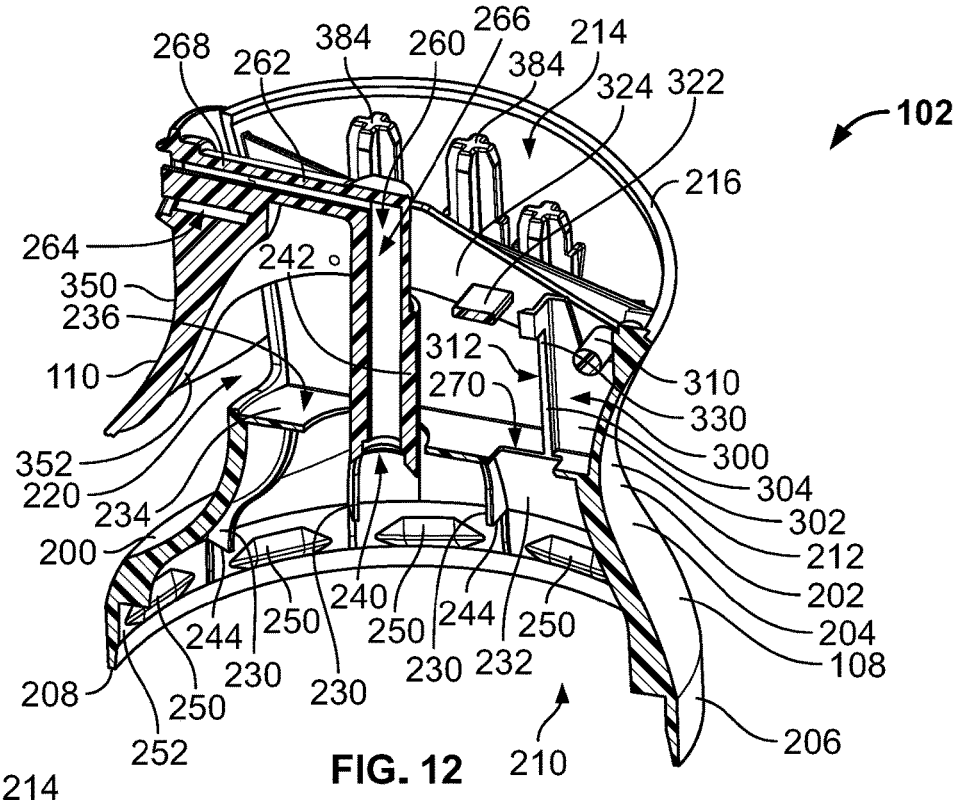
FIG. 12 is a top, rear isometric cross-sectional view of the trigger overcap assembly of FIG. 11 with the cap removed.

Turning to FIGS. 9 and 10, the lower opening 210 of the housing 108 is shown positioned adjacent the lower edge 208 for receiving portions of the container 104. As best seen in FIGS. 10-12, the housing 108 includes a plurality of inwardly protruding guiding ribs 230 disposed along an inner surface 232 of the body 204 of the housing 108. The guiding ribs 230 are radially spaced from one another and extend from the lower edge 208 in an inward and upward manner from an intersection of the lower sidewall 206 with the body 204 along the inner surface 232 to a medial wall 234 that is disposed within the housing 108. The medial wall 234 extends circumferentially about the inner surface 232 of the body 204. A valve stem opening 236 is provided in a central portion of the medial wall 234 through which an inlet 240 of a first or vertical conduit 242 of the trigger 110 extends to join the valve stem 140, resulting in a fluid connection between the trigger 110 and the container 104. As further shown in FIGS. 10-12, a lower surface 244 of each of the guiding ribs 230 is depicted, wherein such lower surfaces 244 are fashioned to engage with the rim 124 of the container 104 when the trigger overcap assembly 102 is coupled thereto.

Referring to FIGS. 9-12, a plurality of equidistantly spaced securement protrusions 250 are disposed circumferentially about an interior surface 252 of the lower sidewall 206 and are adapted to secure the trigger overcap assembly 102 to the container 104 and/or to allow for variances of different container sizes for use with the trigger overcap assembly 102. In a preferred embodiment, the protrusions 250 limit rotation of the housing 108 with respect to the container 104 because the protrusions 250 have a light interface with the groove 120 adjacent the rim 124 of the container 104. The protrusions 250 may also relieve pressure on the lower sidewall 206 of the housing 108 in the event that a container having a larger diameter, i.e., a diameter that is substantially similar to that of the housing, is inserted into the housing 108 of the trigger overcap assembly 102.

As best seen in FIGS. 3, 11 and 12, upon placement of the trigger overcap assembly 102 onto the container 104, the securement protrusions 250 are fittingly retained within the groove 120 in a snap-fit type manner. Any number and size of protrusions 250 may be included that circumscribe the interior surface 252 of the lower sidewall 206 to assist in attaching the trigger overcap assembly 102 to the container 104. Alternatively, other methods may be utilized to secure the trigger overcap assembly 102 to the container 104 as are known in the art. Additional stabilizing ribs (not shown) and/or additional securement protrusions may also provide additional structural integrity and/or alignment assistance to the trigger overcap assembly 102 for allowing for secure retention of the trigger overcap assembly 102. Such alignment assistance helps to ensure that the trigger 110 is positioned correctly onto the valve stem 140.

Still referring to FIGS. 11 and 12, the vertical conduit 242 is shown extending upward, to an intersection 260 with a second or horizontal conduit 262. The horizontal conduit 262 extends from the intersection 260 toward a spray chamber 264 that receives the nozzle insert 112 (not shown in cross-sectional views for clarity). The vertical conduit 242, the horizontal conduit 262, and the spray chamber 264 generally define a fluid passageway 266. When a user actuates the trigger 110 for dispensement, fluid travels through the valve stem 140, into the vertical conduit 242, and into the spray chamber 264, where the pressurized fluid exits the assembly 102 into the surrounding atmosphere. In some embodiments, a cross section of the passageway within the vertical conduit 242 is greater than a cross section of the passageway within the horizontal conduit 262, which may necessarily result in a higher fluid pressure in the horizontal conduit 262 than the vertical conduit 242 during dispensement of the fluid. As a result, pressure of the fluid at different points along the fluid passageway 266 can be adjusted based on varying cross-sectional areas of different portions of the fluid passageway 266, as would be apparent to one having ordinary skill in the art. The vertical conduit 242, the horizontal conduit 262, and the spray chamber 264 define a manifold 268.

The medial wall 234 is also depicted as being interrupted by the valve stem opening 236 and a rear opening 270. The rear opening 270 is disposed adjacent a pivot casing 300, which is a part of the housing 108. The pivot casing 300 includes opposing casing sidewalls 302, a casing front wall 304, and the rear portion 202 of the body 206 of the housing 108. The pivot casing 300 partially surrounds a pivot rod 310 of the trigger 110, and retains the cap 106 in place. The casing front wall 304 also defines a casing aperture 312 through which an engaging step 314 of the cap 106 extends to retain the cap 106 in place once the cap 106 has been coupled with the housing 108. The pivot rod 310 of the trigger 110 is pivotally coupled with a pivot leg 320 depending downward from the cap 106. A trigger bar 322 is also shown in the cross-sectional view of FIGS. 11 and 12, which operates to provide stability by statically connecting a first trigger arm 324 with a second trigger arm 326 (see FIG. 15).

Figure 13:
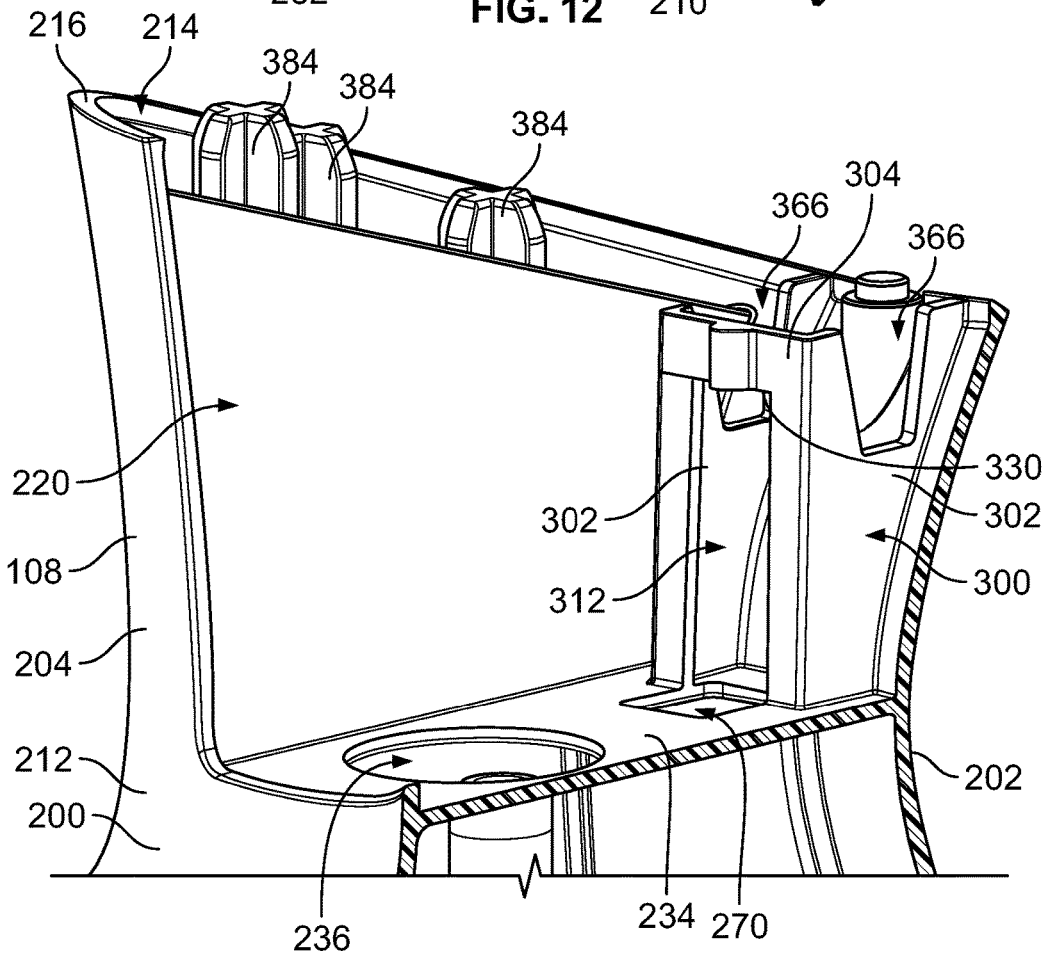
FIG. 13 is a front, right isometric cross-sectional view of a housing of the trigger assembly of FIG. 4 taken through line 13-13 of FIG. 6, with a cap and trigger removed.

Referring now to FIG. 13, the pivot casing 300 is shown in greater detail. As illustrated, the pivot casing 300 includes the casing front wall 304 that defines the casing aperture 312 through which the engaging step 314 of the cap 106 can extend to retain the cap 106 in place. The walls 302, 304 of the pivot casing 300 provide structural integrity to the pivot casing 300 and provide the necessary support to keep the cap 106 fixedly secured to the housing 108 after the cap 106 has been assembled thereto. Because the trigger 110 is pivotally coupled with the cap 106, when the trigger 110 is actuated by a user, an upward force is applied to the cap 106. However, the cap 106 remains in place, in part, by the engaging step 314 being fixed within the casing aperture 312, i.e., the engaging step 314 is held in place within the casing aperture 312 by a lower ledge 330 of the casing front wall 304. In some embodiments, the pivot casing 300 may comprise alternative forms.

Figure 14:
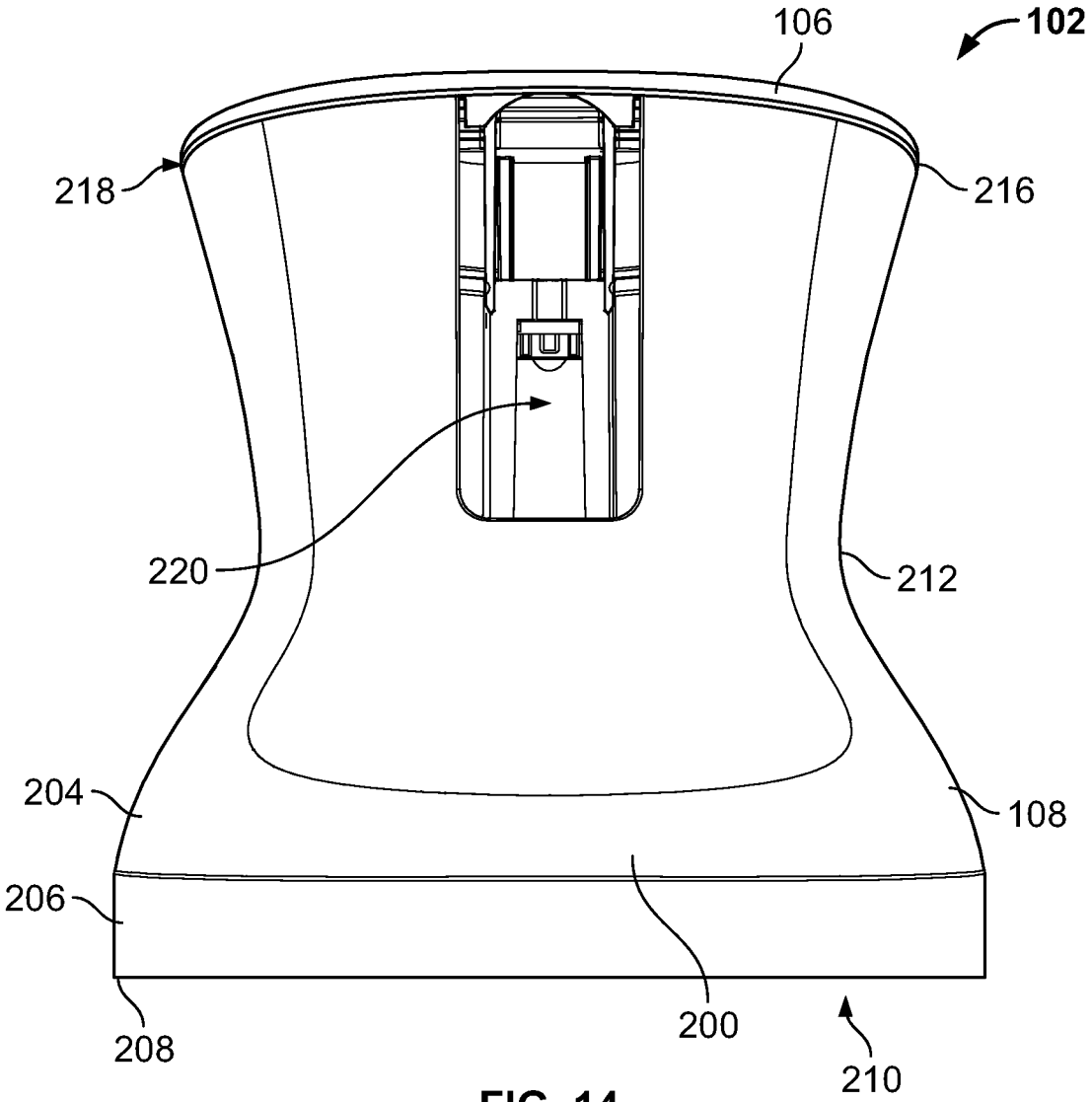
FIG. 14 is a front elevational view of the trigger overcap assembly of FIG. 4 without a trigger.

With reference to FIG. 14, the body 204 along the front portion 200 of the housing 108 is interrupted by the trigger opening 220. The trigger opening 220 of the body 206 is defined by rounded corners and generally straight sides, however, the trigger opening 220 may have any configuration that allows the trigger 110 to move freely within the trigger opening 220 between actuated and non-actuated states. The trigger opening 220 may have other shapes or truncated shapes, such as an oval, a square, a triangle, a rectangle, a circle, or any other shape. A portion of the cap 106 disposed at an upper end of the trigger opening 220 operates as a stop to prevent upward vertical translation or rotation of the trigger 110, as will be described in further detail hereinafter below. The shape of the trigger opening 220 may be different depending on the desired function of the housing 108.

Figure 15:
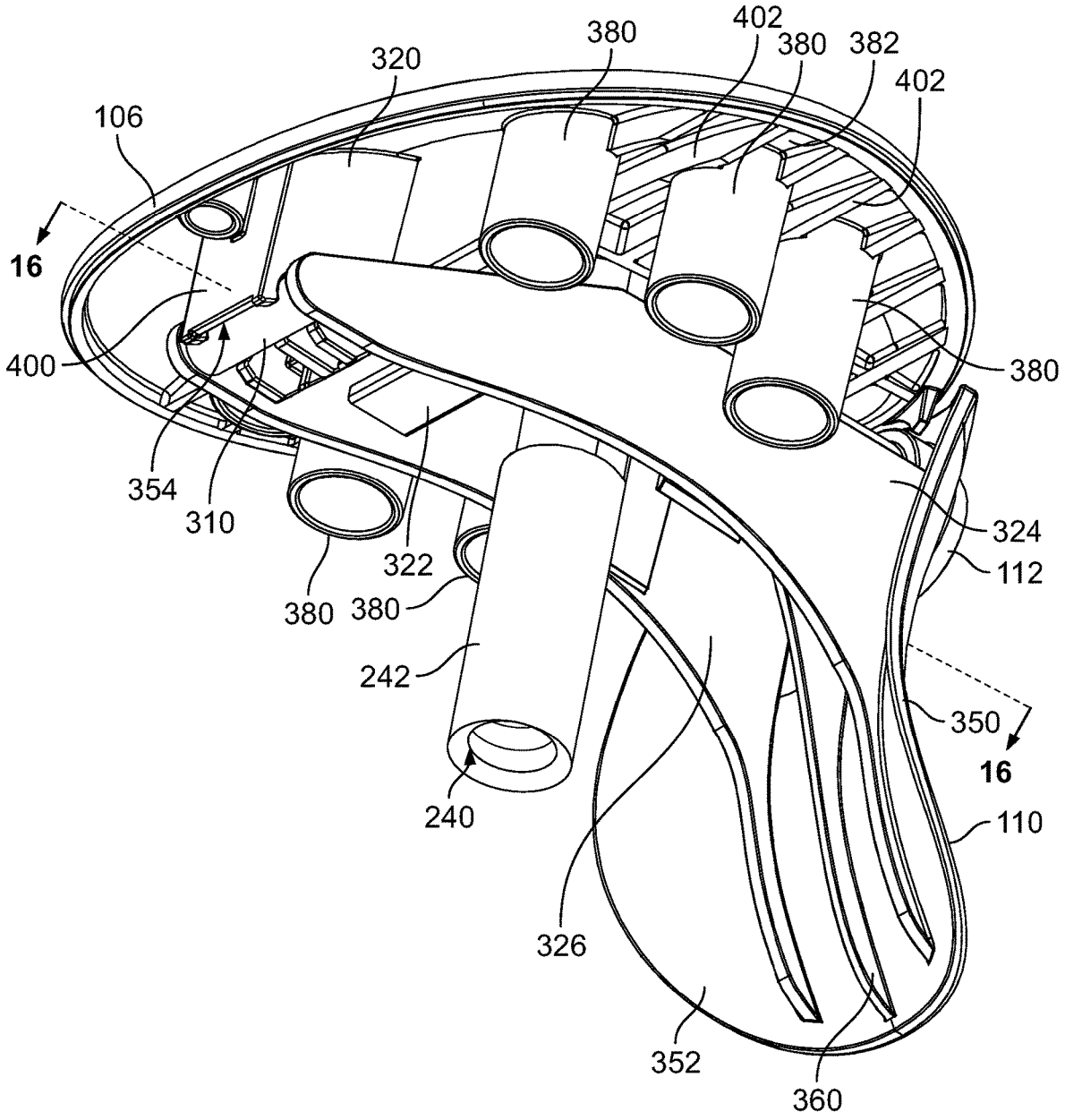
FIG. 15 is a bottom, rear isometric view of a trigger and cap of the trigger overcap assembly of FIG. 4.
Figure 16:
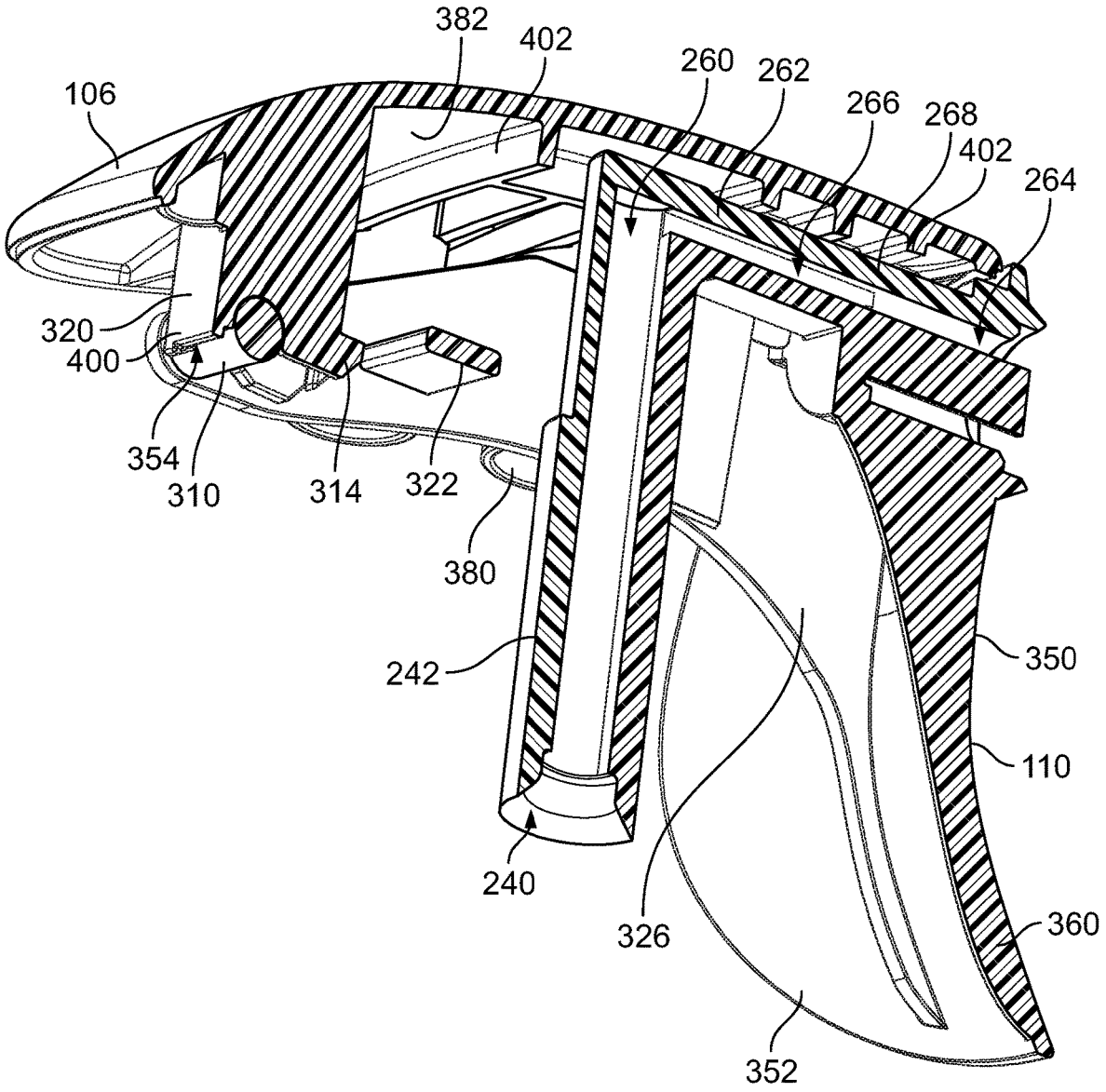
FIG. 16 is a bottom, rear, isometric cross-sectional view of the trigger and cap taken along line 16-16 of FIG. 15.

Now referring to FIGS. 15 and 16, the trigger 110 and the cap 106 are shown pivotally coupled together without the other components of the trigger assembly 102. The trigger 110 is defined by a trigger pad 350 that is generally concave or inwardly bowed. The first and second trigger arms 324, 326 extend from an underside 352 of the trigger pad 350 toward the pivot rod 310. The pivot rod 310 is received within a pivot notch 354 of the pivot leg 320 of the cap 106, as will be discussed in greater detail below. The pivot rod 310 is provided between the first and second trigger arms 324, 326, which provides structural support to the trigger 110. A center arm 360 also extends from the underside 352 of the trigger pad 350 inwardly toward the longitudinal axis A, and terminates at an end of the spray chamber 264. Additional arms or structure may be provided along the underside 352 of the trigger pad 350 to provide additional structural support, to aid with alignment of the trigger pad 350, or for some other reason.

Referring to FIG. 16, the engaging step 314 is shown, which extends outward from the pivot leg 320 that depends from the cap 106. The engaging step 314 extends from the pivot leg 320, inwardly, toward the longitudinal axis A. The engaging step 314 is formed to fit within the pivot casing aperture 312, as described above and shown in FIG. 13. The engaging step 314 may be formed to be snugly received within the casing aperture 312. Referring again to FIG. 13, rod cut-outs 366 are formed within the casing sidewalls 302, the rod cut-outs 366 being formed to allow the pivot rod 310 and portions of the pivot arms 324, 326 adjacent the pivot rod 310 to be able to move freely within and/or adjacent the pivot casing 300.

Figure 17:
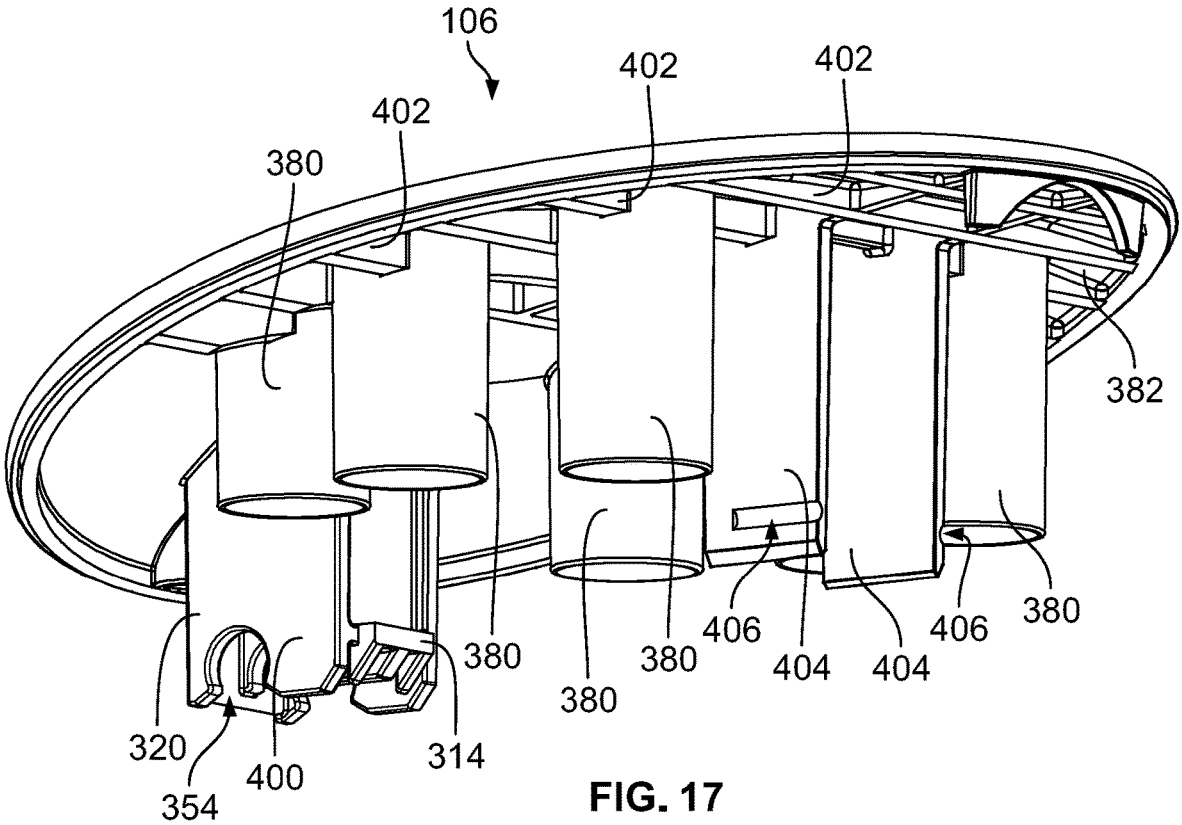
FIG. 17 is a bottom, front isometric view of a cap of the trigger overcap assembly of FIG. 4.

Referring to FIG. 17, the cap 106 is shown in greater detail. A plurality of engagement cylinders 380 extend downward from an underside 382 of the cap 106. The engagement cylinders 380 are formed to engage with protrusions or rods 384 that extend upward from the housing 108 and are received within the engagement cylinders 380. The rods 384 are shown, for example, in FIG. 13. The rods 384 may have any type of cross section, however, in some embodiments the rods 384 have a plus-sign cross-section, as presently depicted. The rods 384 may have rounded or tapered upper portions to allow for better fitting engagement with the engagement cylinders 380 depending from the cap 106.

Turning again to FIG. 17, the pivot leg 320 is shown in greater detail. As shown, the engaging step 314 extends outward from the pivot leg 320, and the pivot notch 354 is formed within a lower end 400 of the pivot leg 320. The pivot notch 354 is formed to fittingly receive the pivot rod 310, in such a way that when the pivot notch 354 is pressed against the pivot rod 310, the pivot rod 310 snaps into place within the pivot notch 354. A plurality of structural support ribs 402 are also shown, which are included for the purpose of providing additional structural integrity to the underside 382 of the cap 106. The support ribs 402 may be formed in a criss-cross pattern along the underside 382 of the cap 106.

As further shown in FIG. 17, two flanges 404 extend downward from the underside 382 of the cap 106, which are formed to interact with portions of the trigger 110. The flanges 404 include grooves 406 that retain knubs or protrusions 408 (see FIG. 19 where only arm 326 is shown) along the arms 324, 326 of the trigger. The grooves 406 extend along a portion of the flanges 404, but may extend along an entire width of the flanges 404. The protrusions 408 form a secondary retention mechanism, which assists in holding the trigger 110 in place during assembly and/or transport of the assembly 102. The trigger 110 is held within the cap 106 during assembly so that both the cap and the trigger 110 may be seated onto the housing 108 at the same time.

Figure 18:
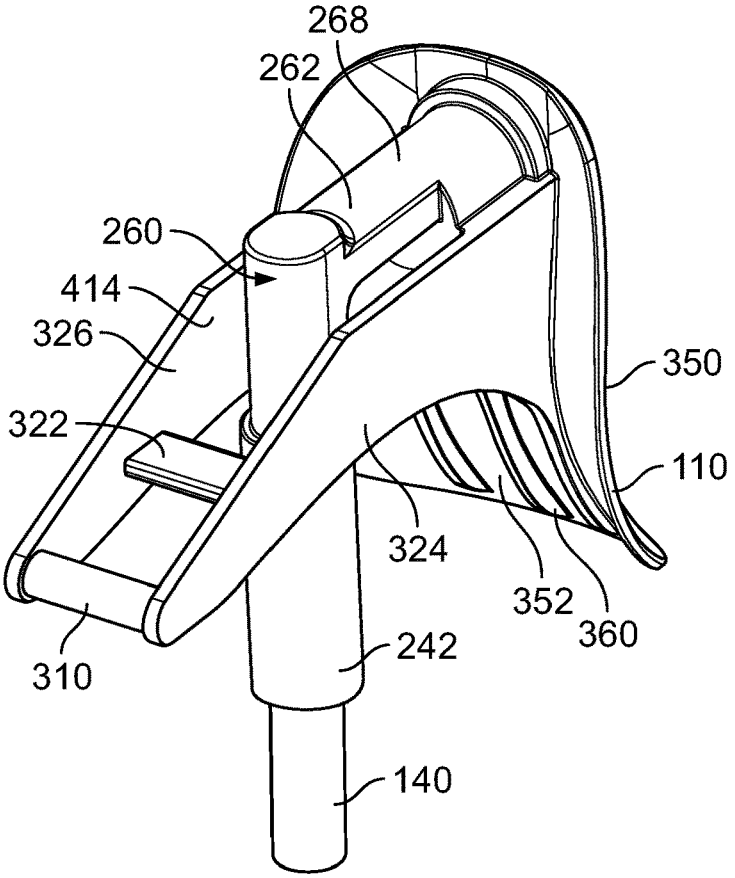
FIG. 18 is a top, rear isometric view of a trigger of the trigger overcap assembly of FIG. 4.
Figure 19:
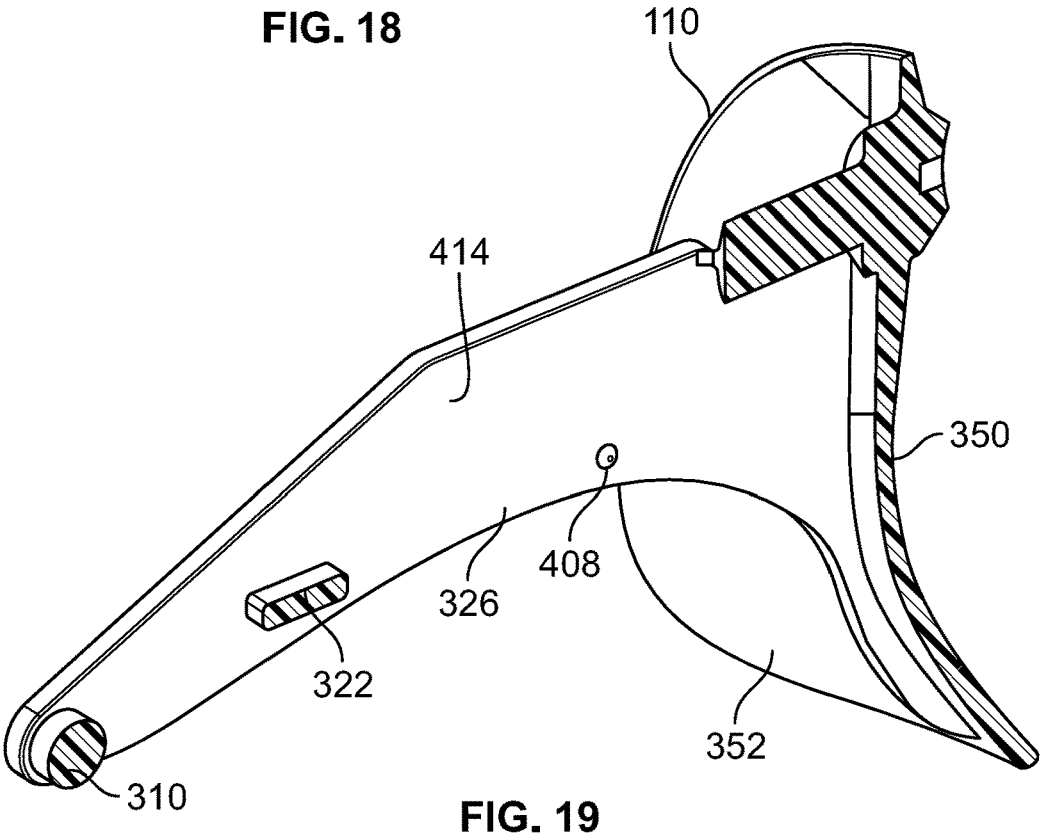
FIG. 19 is a top, rear, isometric cross-sectional view of the trigger of FIG. 18 taken along line 19-19 of FIG. 21.

Now referring to FIGS. 18-23, the trigger 110 is shown in greater detail. The trigger 110 includes the trigger arms 324, 326 that extend from the trigger pad 350 toward the pivot rod 310. The trigger bar 322 also extends between the pivot arms 324, 326 and provides structural support therebetween. The manifold 268 is also shown, which includes the horizontal conduit 262 and the vertical conduit 242. In FIG. 18 the vertical conduit 242 is shown coupled with the valve stem 140. Referring now to FIG. 19, a cross-sectional view of the trigger 110 is shown taken through lines 19-19 of FIG. 21. As shown, one of the protrusions 408 is provided along interior sides 414 of the trigger arms 324, 326. As discussed above, the protrusions 408 may be included to assist in retaining the trigger 110 in place during assembly 102 of the trigger overcap assembly 102.

Figure 20:
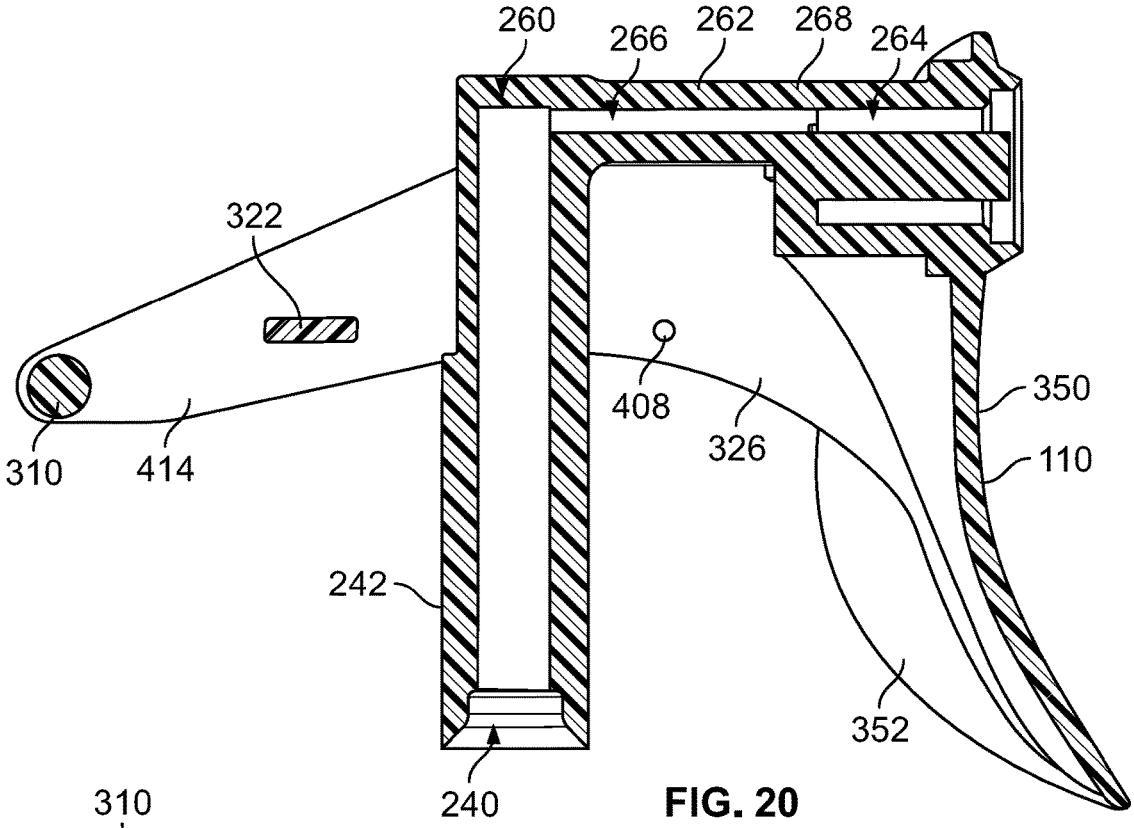
FIG. 20 is a side elevational, cross-sectional view of the trigger of FIG. 18 taken along line 20-20 of FIG. 21.
Figure 21:
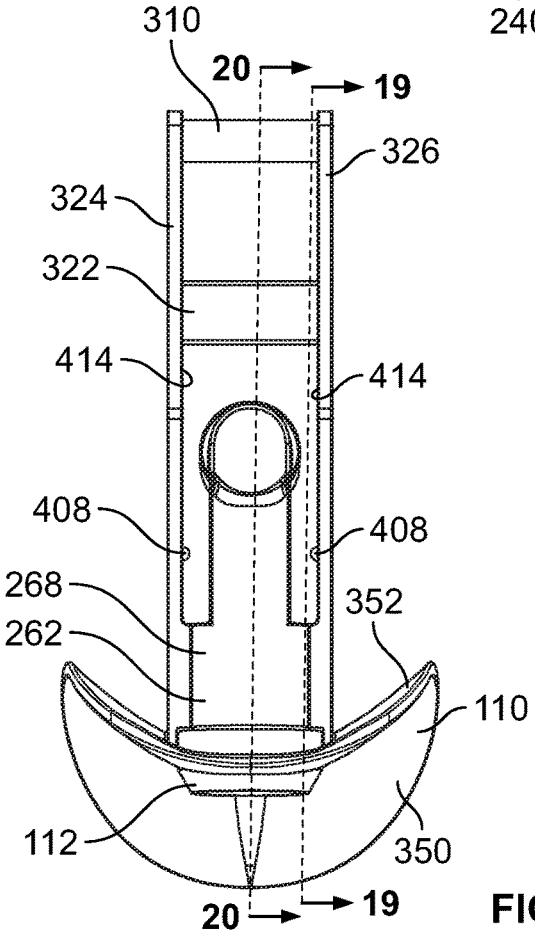
FIG. 21 is a top plan view of the trigger of FIG. 18.
Figure 22:
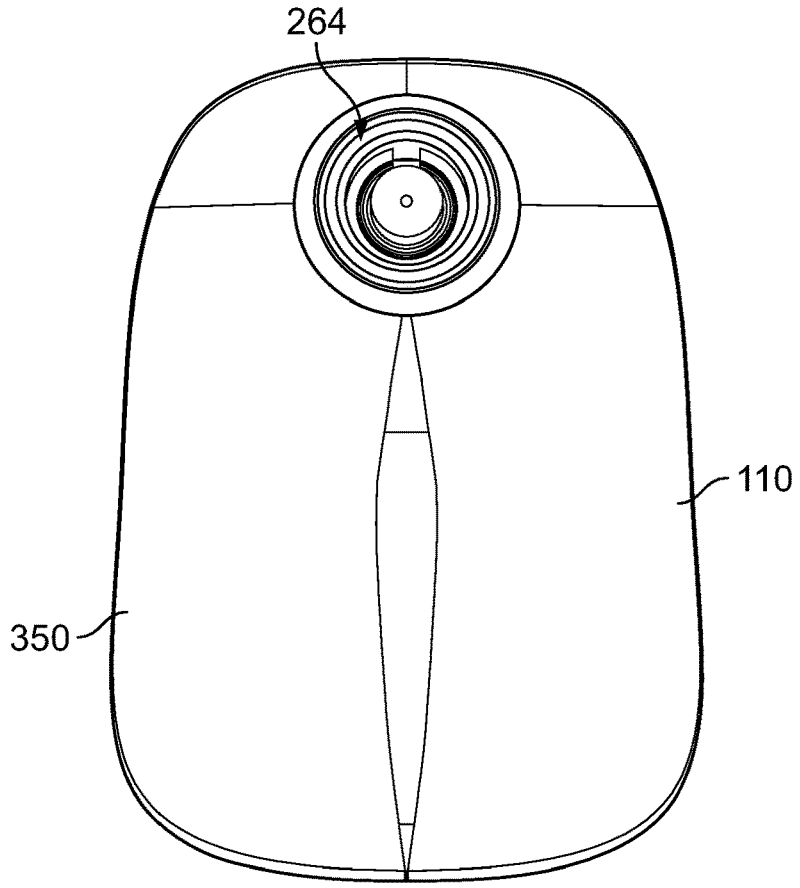
FIG. 22 is a front elevational view of the trigger of FIG. 18.
Figure 23:
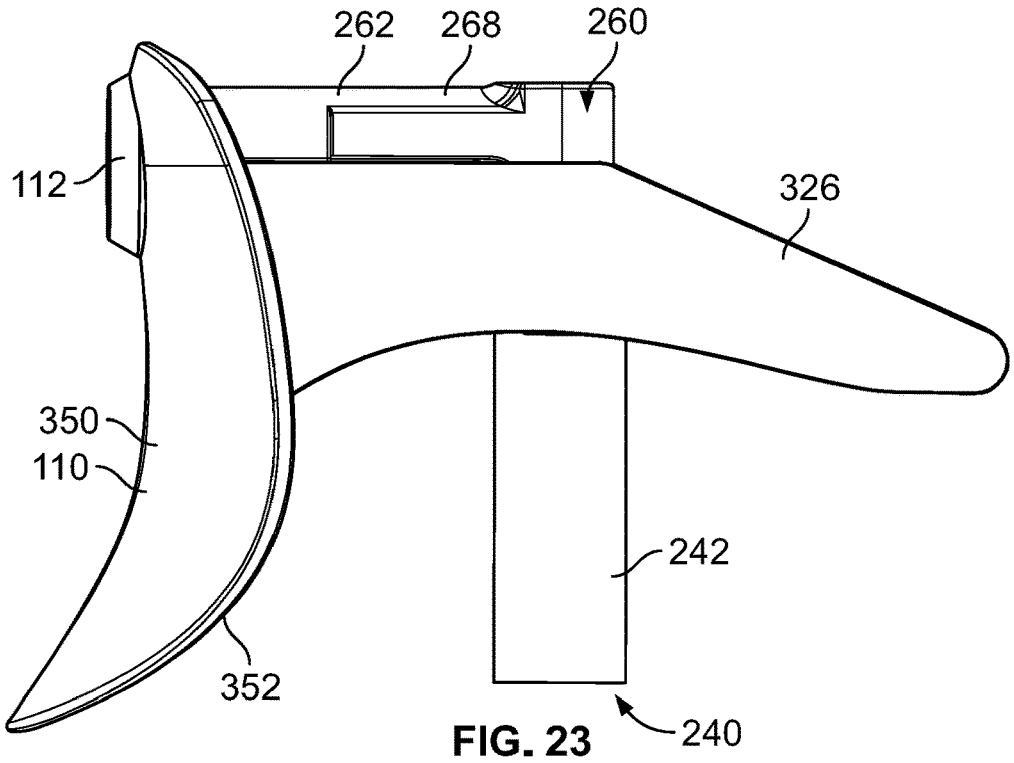
FIG. 23 is a side elevational view of the trigger of FIG. 18.

Referring now to FIG. 20, the pivot rod 310, the trigger bar 322, and the manifold 268 are shown in greater detail. As discussed above, a diameter of the passageway within the vertical conduit 242 is larger than a diameter of the passageway within the horizontal conduit 262 of the manifold 268, which can result in a pressure differential that increases pressure within the horizontal conduit 262 and/or the spray chamber 264 that is formed to receive the nozzle insert 112 (not shown in cross-section). The concave nature of the trigger pad 350 is also shown in FIG. 20. FIGS. 21-23 generally depict plan and elevation views of the trigger 110 separated from the other components of the trigger overcap assembly 102.

Now referring to FIGS. 24 and 25, operation of the trigger overcap assembly 102 will be described in greater detail. As an initial matter, after a first use of the trigger overcap assembly 102, the protrusions 408 provided along the interior sides 414 of the trigger arms 324, 326 disengage from the grooves 406 provided within the flanges 404 that depend from the underside 382 of the cap 106. The disengagement of the protrusions 408 from the grooves 406 allows the trigger 110 to be free to move without interacting with the flanges 404. Further, after a first use of the trigger overcap assembly 102, the vertical conduit 242 of the manifold 268 becomes fully seated on the valve stem 140 of the aerosol container 104. The trigger 110 is then free to pivot within the pivot notch 354 of the cap 106.

Figure 24:
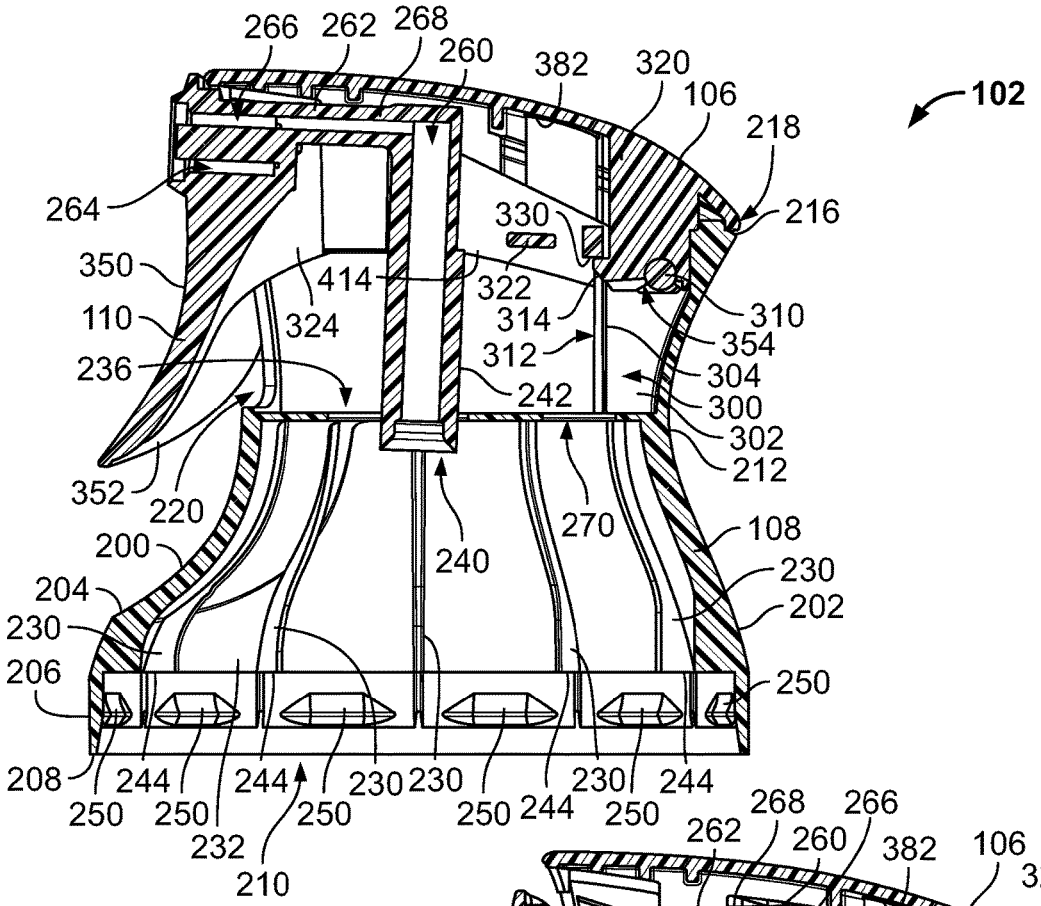
FIG. 24 is a side cross-sectional view of the trigger overcap assembly of FIG. 11 in an unactuated state.
Figure 25:
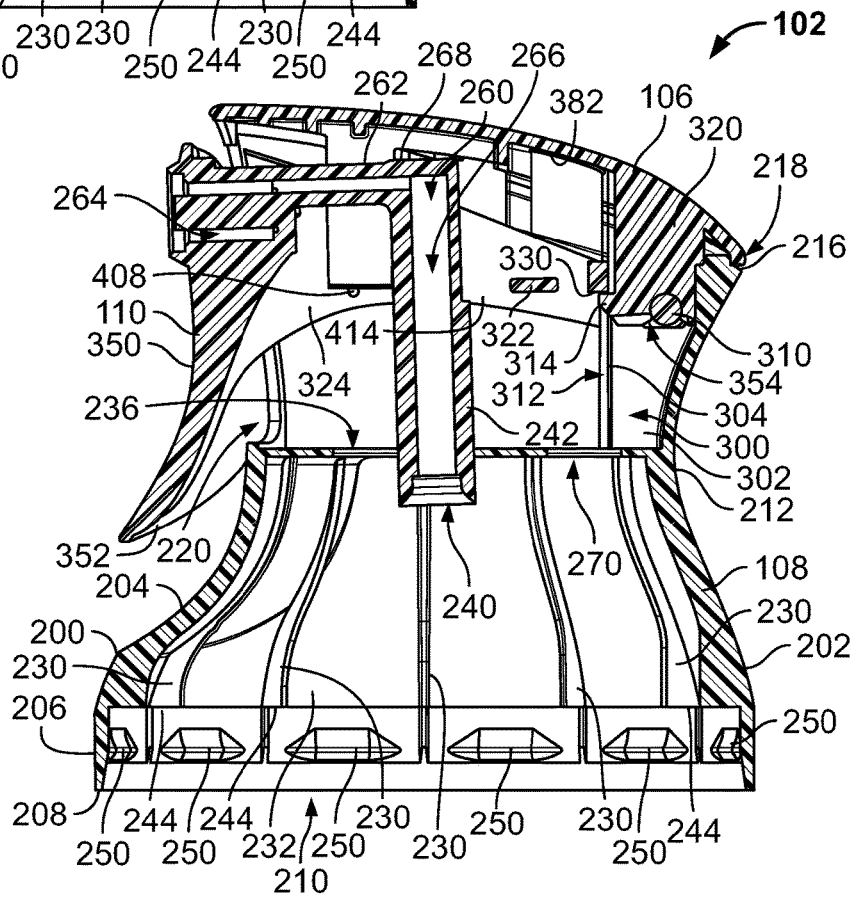
FIG. 25 is a side cross-sectional view of the trigger overcap assembly of FIG. 24 in an actuated state.

The trigger overcap assembly 102 is shown in a non-actuated configuration in FIG. 24 and an actuated configuration in FIG. 25. To place the trigger overcap assembly 102 into an operable condition, the trigger 110 is coupled with the cap 106 and the combination of the trigger 110 and cap 106 is slid through the upper opening 214 of the housing 108. The pivot leg 320 that depends downwardly from the underside 382 of the cap 106 slides into the pivot casing 300, the engaging step 314 snaps into the casing aperture 312, and the engaging step 314 engages with the casing front wall 404 to retain the cap 106 in position on the housing 108. Further, the plurality of engagement rods 384 may form a friction fit with the corresponding plurality of engagement cylinders 380. Before or after the cap 106 and trigger 110 have been secured to the housing 108, the nozzle insert 112 is slid into the spray chamber 264. After the four main components have been coupled together, i.e., the housing 108, the trigger 110, the cap 106, and the nozzle insert 112, the trigger overcap assembly 102 is ready for use.

In use, the product or fluid is sprayed from the dispensing system 100 by exerting a force on the trigger 110. Referring to FIG. 25, which shows the trigger overcap assembly 102 during actuation, the vertical conduit 242 is forced downward, and presses down on the valve stem 140 to cause the valve assembly to allow product or fluid to enter into the manifold 268. In a preferred embodiment, the valve stem 140 translates between about 0.5 mm and about 10 mm, or between about 1 mm and about 8 mm from the non-actuation position to the actuation position. Upon removal of force from the trigger 110, the manifold 268 returns to the non-actuation position, as shown in FIG. 24. The trigger 110 is moved to the non-actuation position by the force of the valve stem 140 moving upwardly by the valve spring to close the valve assembly within the container 104.

It should also be noted that the trigger overcap assembly 102 depicted in FIG. 25 in the actuation state is shown in a fully actuated state. However, depending on the tolerance or specific characteristics of the container and/or valve stem and accompanying valve assembly, it is possible that spraying may be effected either fully or partially by pressing the actuator downward somewhere between the two positions shown in FIG. 24 (non-actuated) and FIG. 25 (fully actuated). However, for purposes of explaining the functionality and interaction of the trigger 110 with the housing 108, the term "actuation state" as it relates to the trigger overcap assembly 102 shown in FIG. 25 refers to what is, in fact, a fully actuated state of the trigger overcap assembly 102.

With reference still to FIGS. 24 and 25, when a user exerts a force on the trigger pad 350 to translate the trigger 110 from its non-actuation state, the outlet orifice 114 of the trigger 110 is moved from a first position to a second position. As shown in FIG. 24, when the trigger overcap assembly 102 is in the non-actuation state, portions of the trigger 110 are in contact or engaged with surfaces defining the trigger opening 220 of the body 206 of the housing 108. Further, the pivot rod 310 of the trigger 110 is disposed within the pivot notch 354 of the pivot leg 320 depending from the underside 382 of the cap 106. The trigger 110 remains in the non-actuation state due to the force of the valve spring (not shown) until a user presses inwardly and/or downwardly on the trigger pad 350 of the trigger 110 to translate the trigger 110 from the non-actuation state to the actuation state. Referring now to FIG. 25, the trigger 110 is shown translated vertically downward to the actuation state. The trigger 110 remains in the actuation state until a user releases the trigger pad 350 of the trigger 110 to allow translation of the trigger 110 from the actuation state (FIG. 25) back to the non-actuation state (FIG. 24).

It is contemplated that the trigger overcap assembly 102 disclosed herein may be mated with a container that has a non-vertical valve assembly or with a valve stem that requires angular motion for actuation. Further, while the teachings of the present overcap assemblies are particularly beneficial to containers having smaller footprints, the present embodiments could be utilized with any size container.

Any of the embodiments described herein may be modified to include any of the structures or methodologies disclosed in connection with different embodiments. Further, the present disclosure is not limited to aerosol containers of the type specifically shown. Still further, the overcaps of any of the embodiments disclosed herein may be modified to work with any type of aerosol or non-aerosol container.

INDUSTRIAL APPLICABILITY

Numerous modifications to the present invention will be apparent to those skilled in the art in view of the foregoing description. Accordingly, this description is to be construed as illustrative only and is presented for the purpose of enabling those skilled in the art to make and use the invention and to teach the best mode of carrying out same. The exclusive rights to all modifications which come within the scope of the appended claims are reserved.

We claim:

1. A trigger overcap assembly, comprising:

a housing having a body;

a cap secured to an upper end of the housing; and a trigger at least partially disposed within the body, wherein the trigger defines a manifold comprising a fluid passageway, and wherein a pivot rod of the trigger is pivotally coupled with a pivot notch of the cap.

2. The trigger overcap assembly of claim 1, wherein the pivot notch is disposed within a pivot leg that depends from an underside of the cap.

3. The trigger overcap assembly of claim 1, wherein the manifold includes a vertical conduit and a horizontal conduit that are joined at an intersection.

4. The trigger overcap assembly of claim 3, wherein a diameter of a first portion of the fluid passageway within the vertical conduit is greater than a diameter of a second portion of the fluid passageway within the horizontal conduit.

5. The trigger overcap assembly of claim 1, wherein the trigger includes a trigger pad, and wherein a first trigger arm and a second trigger arm each extend from the trigger pad to the pivot rod.

6. The trigger overcap assembly of claim 5, wherein a trigger arm connects the first trigger arm with the second trigger arm.

7. The trigger overcap assembly of claim 1 further comprising a pivot casing within the housing, the pivot casing comprising at least one sidewall defining a casing aperture, wherein an engaging step extends from a pivot leg that depends from an underside of the cap into the casing aperture.

8. The trigger overcap assembly of claim 1, wherein the body of the housing has a waisted portion.

9. The trigger overcap assembly of claim 1 further comprising a plurality of securement protrusions provided along an interior side of the body that are operable to engage with a rim of a container.

10. The trigger overcap assembly of claim 1 further comprising a plurality of engagement cylinders that depend from the cap and engage with a plurality of engagement rods of the housing.

11. A four piece trigger overcap assembly, consisting of:

a housing;

a cap secured to an upper end of the housing;

a trigger at least partially disposed within the housing; and a nozzle insert disposed within a nozzle chamber of the trigger, wherein the trigger defines a fluid passageway, and wherein a pivot rod of the trigger is pivotally coupled with the cap.

12. The trigger overcap assembly of claim 11, wherein the housing includes a trigger aperture through which the trigger is movable.

13. The trigger overcap assembly of claim 11, wherein the trigger is defined by a trigger pad from which first and second pivot arms extend to join the pivot rod.

14. The trigger overcap assembly of claim 11, wherein the fluid passageway has a vertical conduit, a horizontal conduit, and a spray chamber.

15. A trigger overcap assembly, comprising:

a housing defined by a waisted body from which extends a lower sidewall;

a cap secured to an upper end of the body; and a trigger at least partially disposed within the body, the trigger comprising a trigger pad from which a first arm and a second arm extend into the housing, wherein the trigger defines a manifold comprising a fluid passageway, and wherein a pivot rod connecting the first and second arms of the trigger is pivotally coupled with a pivot notch within a leg depending from the cap.

16. The trigger overcap assembly of claim 15, wherein the pivot notch and the pivot rod are at least partially disposed within a pivot casing.

17. The trigger overcap assembly of claim 16, wherein the pivot casing includes a front casing wall and at least one side casing wall, and wherein the at least one side casing wall includes a rod cut-out to receive the pivot rod.

18. The trigger overcap assembly of claim 15, wherein a first conduit partially defining the fluid passageway has a first diameter, and a second conduit partially defining the fluid passageway has a second diameter, the first diameter being greater than the second diameter.

19. The trigger overcap assembly of claim 15, wherein the trigger pad is disposed entirely outside of the housing.

20. The trigger overcap assembly of claim 15, wherein the cap is secured to the housing via an engagement step that is engaged within an aperture provided along a portion of the housing.

21. The trigger overcap assembly of claim 1, wherein the pivot notch defines a pivot axis and the trigger pivots about the pivot axis when the trigger is engaged.

22. The trigger overcap assembly of claim 15, wherein the pivot notch defines a pivot axis and the trigger pivots about the pivot axis when the trigger is engaged.

* * * * *